US012235025B2

(12) United States Patent
Wong

(10) Patent No.: US 12,235,025 B2
(45) Date of Patent: Feb. 25, 2025

(54) AIR CONDITIONING AND HEAT PUMP SYSTEM WITH ENERGY EFFICIENT HEAT EXCHANGER

(71) Applicant: Lee Wa Wong, Alhambra, CA (US)

(72) Inventor: Lee Wa Wong, Alhambra, CA (US)

( * ) Notice: Subject to any disclaimer, the term of this patent is extended or adjusted under 35 U.S.C. 154(b) by 0 days.

(21) Appl. No.: 18/737,826

(22) Filed: Jun. 7, 2024

(65) Prior Publication Data

US 2024/0328686 A1 Oct. 3, 2024

Related U.S. Application Data

(62) Division of application No. 18/264,147, filed as application No. PCT/US2021/016683 on Feb. 4, 2021, now Pat. No. 12,018,870.

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01); *F25B 2500/18* (2013.01)

(58) Field of Classification Search
CPC ..... F25B 2500/18; F25B 13/00; F25B 41/20
See application file for complete search history.

(56) References Cited

U.S. PATENT DOCUMENTS 3,916,638 A 11/1975 Schmidt
4,091,636 A * 5/1978 Margen ..... F25B 30/06 165/45
5,749,235 A * 5/1998 Ueda ..... B60H 1/00314 62/238.7
6,041,613 A 3/2000 Morse et al.
8,794,015 B1 * 8/2014 Dahlen ..... F25B 30/06 62/79
9,759,456 B2 * 9/2017 Hancock ..... F25B 13/00
9,797,611 B2 * 10/2017 Gault ..... F25B 13/00
9,811,126 B2 * 11/2017 Chainer ..... H05K 7/20654
9,816,739 B2 * 11/2017 Tambovtsev ..... F25B 6/02
10,883,746 B2 * 1/2021 Leiper ..... F25B 49/02
11,655,896 B2 * 5/2023 Welch ..... F25B 13/00 62/498
2016/0091215 A1 3/2016 Wong
2019/0264927 A1 8/2019 Suzuki et al.

* cited by examiner

*Primary Examiner* — Filip Zec
(74) *Attorney, Agent, or Firm* — Tsz Lung Yeung

(57) ABSTRACT

An air conditioning and heat pump system includes an outdoor main unit and an indoor heat distribution system. The main outdoor unit includes a compressor, a refrigerant storage tank, a switching valve, a first outdoor heat exchanger and a cooling tower. The indoor heat distribution system includes at least one indoor heat exchanger, and a ventilating device. The ventilating device includes a supporting frame, a ventilating heat exchanging unit and an energy efficient heat exchanger supported in the supporting frame at a position between an air intake opening and the ventilating heat exchanging unit such that the ambient air from the air intake opening is arranged to pass through the energy efficient heat exchanger before passing through the ventilating heat exchanging unit. Refrigerant circulating between the main outdoor unit and the indoor heat distribution system may be cooled by cooling water and ambient air.

19 Claims, 8 Drawing Sheets

AIR CONDITIONING AND HEAT PUMP SYSTEM WITH ENERGY EFFICIENT HEAT EXCHANGER

CROSS REFERENCE OF RELATED APPLICATION

This is divisional application of a non-provisional application Ser. No. 18/264,147 with a filing date of Aug. 3, 2023, which is a national phase national application of an international patent application number PCT/US2021/016683 with a filing date of Feb. 4, 2021. The contents of these specifications, including any intervening amendments thereto, are incorporated herein by reference.

BACKGROUND OF THE PRESENT INVENTION

Field of Invention

The present invention relates to an air conditioning and heat pump system, and more particularly to an air conditioning and heat pump system comprising an energy efficient heat exchanger which is capable of saving a substantial amount of energy.

Description of Related Arts

Conventional air conditioning and heat pump systems, such as an air conditioning and heat pump system comprising an outdoor main unit and several indoor units, have widely been utilized around the world. Some technologies have been developed to control the flow of refrigerant between the outdoor main unit and the indoor units. One such conventional technology is known as "Variable Refrigerant Volume".

Referring to FIG. 1 to FIG. 3 of the drawings, a conventional air conditioning and heat pump system may comprise an outdoor main unit 1P and an indoor heat distribution system 2P. The outdoor main unit 1P usually comprises a main casing 100P, at least one compressor 101P, an outdoor heat exchanger 102P, and at least one outdoor fan 103P. The main casing 100P has an air inlet 105P and an air outlet 106P, wherein ambient air may be drawn to flow from the air inlet 105P to the air outlet 106P and pass through the outdoor heat exchanger 102P. A predetermined amount of refrigerant may circulate between the outdoor main unit 1P and the indoor heat distribution system 2P. Refrigerant from the indoor heat distribution system 2P is guided to enter the outdoor heat exchanger 102P and perform heat exchange with the ambient air drawn from the air inlet 105P. The refrigerant flowing through the outdoor heat exchanger may absorb heat from the ambient air or release heat thereto, depending on the operation of the conventional air conditioning and heat pump system.

As shown in FIG. 3 of the drawings, the indoor heat distribution system 2P usually comprises a plurality of indoor heat exchangers 401P connected in parallel. These indoor heat exchangers 401P are located in different designated indoor spaces and connected to the outdoor heat exchanger 102P. Refrigerant may circulate between the outdoor heat exchanger 102P and the indoor heat exchangers 401P in a predetermined heat exchange cycle so that heat may be released to or extracted from each of the indoor heat exchangers 401P. Each of the indoor heat exchangers 401P is arranged to provide conditioned or heated air to a designated indoor space.

Several refrigerant control techniques have been developed to control the flow of refrigerant between the outdoor main unit 1P and each of the indoor heat exchangers 401P. One of such techniques is "Variable Refrigerant Volume" technique mentioned above.

Although the above-mentioned air conditioning and heat pump systems have widely been utilized around the world for many years, these systems suffer a common deficiency of a relatively low Coefficient of Performance (COP), which may be defined as a ratio of heat supplied to or removed from a reservoir to the work required.

Accordingly, there is a need to develop an air conditioning and heat pump system which has substantially improved COP.

SUMMARY OF THE PRESENT INVENTION

Certain variations of the present invention provide an air conditioning and heat pump system which is capable of saving a substantial amount of energy when the air conditioning and heat pump system is being operated.

Certain variations of the present invention provide an air conditioning and heat pump system which may selectively utilize cooling water in a cooling tower to cool down the temperature of the refrigerant when the air conditioning and heat pump system is being operated in a comprehensive air conditioning mode.

Certain variations of the present invention provide an air conditioning and heat pump system which is capable of producing more heat to designated indoor space for a given work done by the system as compared with conventional air conditioning and heat pump system as described above.

In one aspect of the present invention, the present invention provides an air conditioning and heat pump system, comprising:

a plurality of connecting pipes;

a main outdoor unit, which comprises:

a main casing having an air inlet and an air outlet;

at least one compressor supported in the main casing;

a refrigerant storage tank supported in the main casing;

a switching valve supported in the main casing;

a first outdoor heat exchanger supported in the main casing and connected to the compressor through the switching valve and at least one of the connecting pipes; and a cooling tower which is supported in the main casing, and comprises:

a water collection basin;

a second outdoor heat exchanger provided in the water collection basin and connected to the first outdoor heat exchanger through at least one of the connecting pipes, the second outdoor heat exchanger further connecting to the refrigerant storage tank through at least one of the connecting pipes;

a fill material unit provided underneath the water collection basin;

a water storage basin provided underneath the fill material unit; and a pump connected between the water storage basin and the water collection basin, wherein a predetermined amount of ambient air from the air inlet is arranged to sequentially pass through the fill material unit and the first outdoor heat exchanger, and a predetermined amount of cooling water is arranged to circulate between the water storage basin and the water collection basin, the cooling water in the water storage basin is arranged to be pumped by the pump to the water collection basin for absorbing heat from refrigerant flowing through the second outdoor heat exchanger, the water in the water collection basin is arranged to be distributed on the fill material unit for releasing heat to the ambient air passing through the fill material unit, the cooling water is to be collected in the water storage basin to complete one cooling cycle, the air passing through the fill material unit is arranged to flow through the first outdoor heat exchanger and discharged out of the main casing through the air outlet; and an indoor heat distribution system, which comprises:

at least one indoor heat exchanger connected to the first outdoor heat exchanger, the second outdoor heat exchanger of the cooling tower, and the compressor through at least one of the connecting pipes; and a ventilating device, which comprises:

a supporting frame having an air intake opening exposed to ambient air for allowing intake of air through the air intake opening;

a ventilating heat exchanging unit supported by the supporting frame, and connected to the refrigerant storage tank, the switching valve, and the first outdoor heat exchanger though at least one of the connecting pipes, the ventilating heat exchanging unit and the indoor heat exchanger being connected in parallel;

an energy efficient heat exchanger supported in the supporting frame at a position between the air intake opening and the ventilating heat exchanging unit such that the ambient air from the air intake opening is arranged to pass through the energy efficient heat exchanger before passing through the ventilating heat exchanging unit, the energy efficient heat exchanger being connected to the first outdoor heat exchanger, the second outdoor heat exchanger, and the refrigerant storage tank through at least one of the connecting pipes; and a centrifugal fan supported in the supporting frame, the air conditioning and heat pump system being selectively operated between an air conditioning mode and a heat pump mode, wherein in the air conditioning mode, the switching valve is switched such that a predetermined amount of vaporous refrigerant is arranged to leave the compressor and guided to enter the first outdoor heat exchanger for releasing heat thereto, the refrigerant leaving the first outdoor heat exchanger being guided to flow through the second outdoor heat exchanger for releasing heat to the cooling water circulating in the cooling tower, the refrigerant leaving the second outdoor heat exchanger being guided to flow through the indoor heat exchanger of the indoor heat distribution system for absorbing heat from the indoor heat exchanger, the refrigerant leaving the indoor heat exchanger being guided to flow through the switching valve and flow back to the compressor to complete an air conditioning cycle, wherein when the air conditioning and heat pump system is in the heat pump mode, the switching valve is switched such that a predetermined amount of vaporous refrigerant is arranged to leave the compressor and guided to flow into the indoor heat exchanger and the ventilating heat exchanging unit for releasing heat to a designated indoor space and the ambient air drawn from the air intake opening, the refrigerant leaving the indoor heat exchanger and the ventilating heat exchanging unit being guided to flow through the energy efficient heat exchanger for pre-heating the ambient air drawn from the air intake opening, the refrigerant leaving the energy efficient heat exchanger being guided to flow through the first outdoor heat exchanger for absorbing heat from ambient air passing therethrough, the refrigerant leaving the first outdoor heat exchanger being guided to pass through the switching valve and flow back to the compressor for completing a heat pump cycle.

In another aspect of the present invention, it provides an air conditioning and heat pump system, comprising:

a plurality of connecting pipes;

a main outdoor unit, which comprises:

a main casing having an air inlet and an air outlet;

at least one compressor supported in the main casing;

a refrigerant storage tank supported in the main casing;

a switching valve supported in the main casing;

a first outdoor heat exchanger supported in the main casing and connected to the compressor through the switching valve and at least one of the connecting pipes; and a cooling tower which is supported in the main casing, and comprises:

a first water collection basin;

a first fill material unit provided underneath the first water collection basin;

a second water collection basin provided underneath the first fill material unit;

a third water collection basin provided underneath the second water collection basin;

a third fill material unit provided underneath the third water collection basin;

a water storage basin provided underneath the third fill material unit;

a second outdoor heat exchanger provided in the first water collection basin, the second water collection basin and the third water collection basin; and a pump connected between the water storage basin and the first through third water collection basin, a predetermined amount of ambient air being arranged to pass through the first through third fill material unit and the first outdoor heat exchanger, a predetermined amount of cooling water circulating between the water storage basin, the first through third water collection basin, and first through third fill material unit, the cooling water in the water storage basin being arranged to be pumped to the first water collection basin for absorbing heat from the second outdoor heat exchanger therein, the water in the first water collection basin being arranged to be distributed on the first fill material unit, the cooling water being collected in the second water collection basin for absorbing heat from the second outdoor heat exchanger therein, the cooling water being arranged to flow down to the second fill material unit for being cooled by the ambient air, the cooling water being collected in the third water collection basin for absorbing heat from the second outdoor heat exchanger therein, the cooling water being arranged to flow down to the third fill material unit for being cooled by the ambient air, the cooling water being eventually collected in the water storage basin; and an indoor heat distribution system, which comprises:

at least one indoor heat exchanger connected to the first outdoor heat exchanger, the second outdoor heat exchanger of the cooling tower, and the compressor through at least one of the connecting pipes; and a ventilating device, which comprises:

a supporting frame having an air intake opening exposed to ambient air for allowing intake of air through the air intake opening;

a ventilating heat exchanging unit supported by the supporting frame, and connected to the refrigerant storage tank, the switching valve, and the first outdoor heat exchanger though at least one of the connecting pipes, the ventilating heat exchanging unit and the indoor heat exchanger being connected in parallel;

an energy efficient heat exchanger supported in the supporting frame at a position between the air intake opening and the ventilating heat exchanging unit such that the ambient air from the air intake opening is arranged to pass through the energy efficient heat exchanger before passing through the ventilating heat exchanging unit, the energy efficient heat exchanger being connected to the first outdoor heat exchanger, the second outdoor heat exchanger, and the refrigerant storage tank through at least one of the connecting pipes; and a centrifugal fan supported in the supporting frame, the air conditioning and heat pump system being selectively operated between an air conditioning mode and a heat pump mode, wherein in the air conditioning mode, the switching valve is switched such that a predetermined amount of vaporous refrigerant is arranged to leave the compressor and guided to enter the first outdoor heat exchanger for releasing heat thereto, the refrigerant leaving the first outdoor heat exchanger being guided to flow through the second outdoor heat exchanger for releasing heat to the cooling water circulating in the cooling tower, the refrigerant leaving the second outdoor heat exchanger being guided to flow through the indoor heat exchanger of the indoor heat distribution system for absorbing heat from the indoor heat exchanger, the refrigerant leaving the indoor heat exchanger being guided to flow through the switching valve and flow back to the compressor to complete an air conditioning cycle, wherein when the air conditioning and heat pump system is in the heat pump mode, the switching valve is switched such that a predetermined amount of vaporous refrigerant is arranged to leave the compressor and guided to flow into the indoor heat exchanger and the ventilating heat exchanging unit for releasing heat to a designated indoor space and the ambient air drawn from the air intake opening, the refrigerant leaving the indoor heat exchanger and the ventilating heat exchanging unit being guided to flow through the energy efficient heat exchanger for pre-heating the ambient air drawn from the air intake opening, the refrigerant leaving the energy efficient heat exchanger being guided to flow through the first outdoor heat exchanger for absorbing heat from ambient air passing therethrough, the refrigerant leaving the first outdoor heat exchanger being guided to pass through the switching valve and flow back to the compressor for completing a heat pump cycle.

This summary is included so as to introduce various topics to be elaborated upon below in the detailed description of the preferred embodiment. This summary is not intended to identify key or essential aspects of the claimed invention. This summary is not intended for use as an aid in determining the scope of the claims.

DETAILED DESCRIPTION OF THE PREFERRED EMBODIMENT

Figure 1:
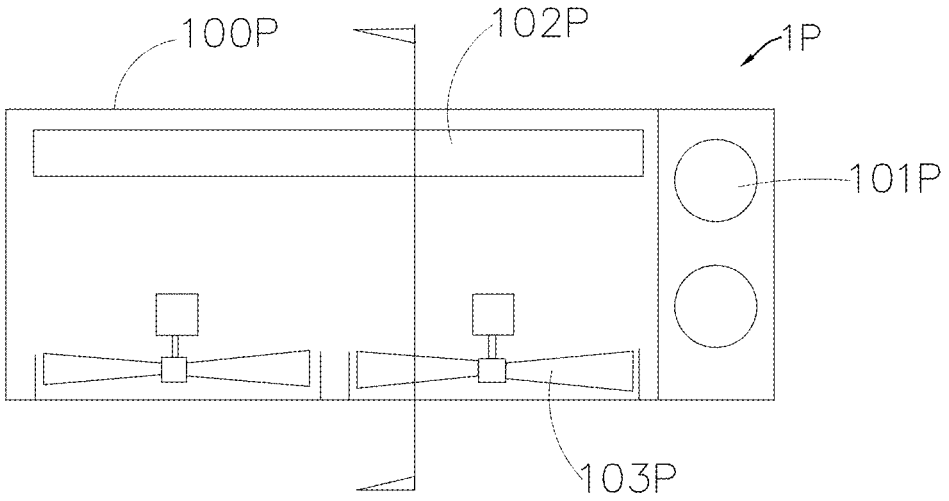
FIG 1 PRIOR ART
FIG. 1 is a schematic diagram of a main outdoor unit of a conventional air conditioning and heat pump system.
Figure 2:
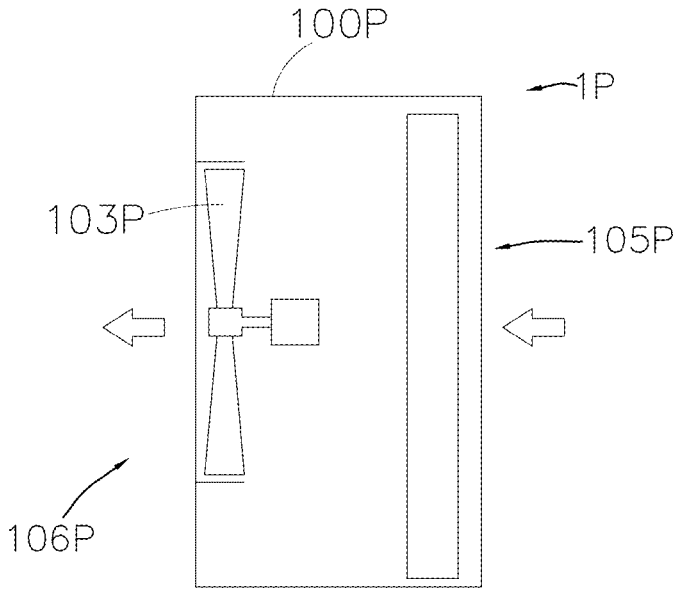
FIG 2 PRIOR ART
FIG. 2 is another schematic diagram of the main outdoor unit of the conventional air conditioning and heat pump system.
Figure 3:
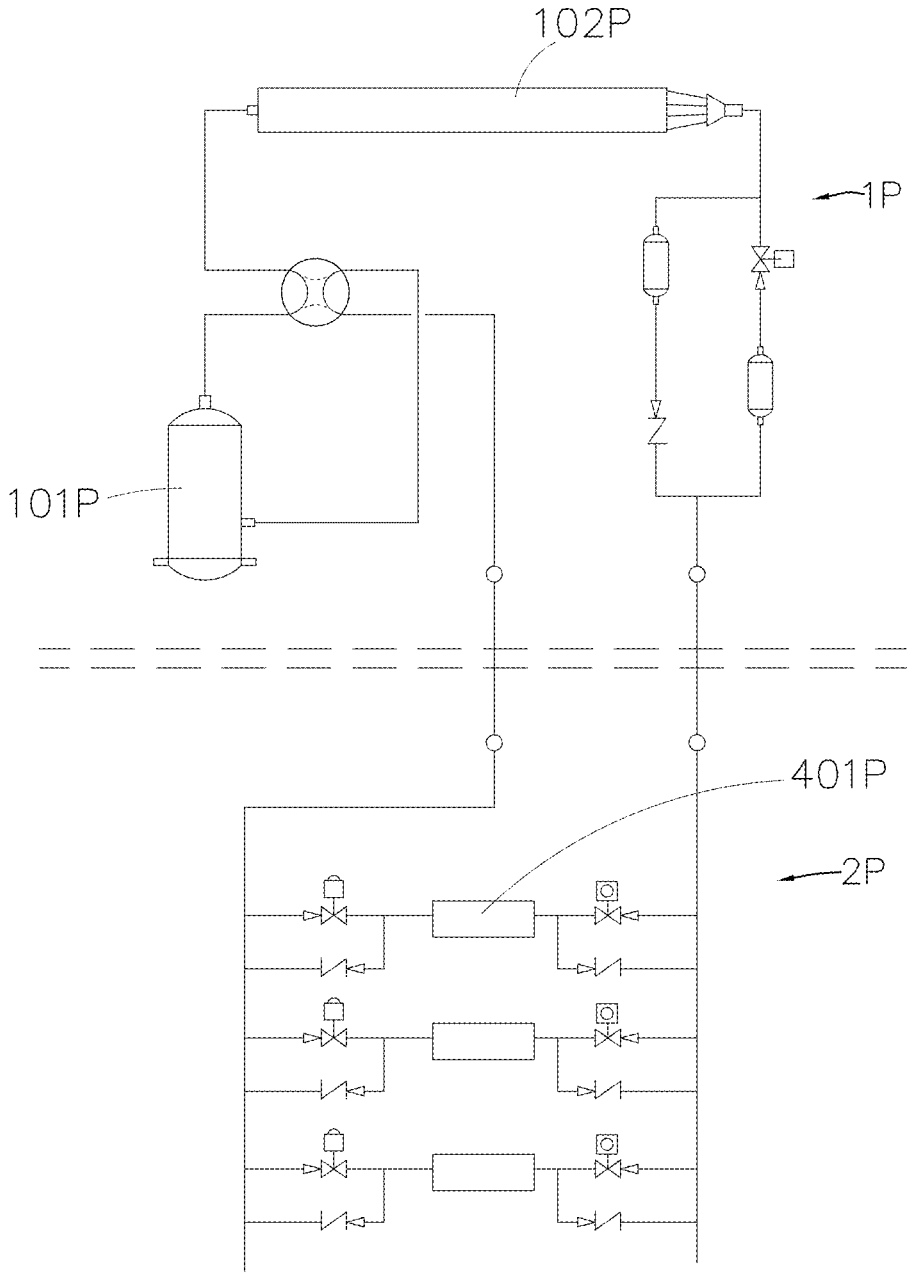
FIG 3 PRIOR ART
FIG. 3 is another schematic diagram of the conventional air conditioning and heat pump system, illustrating a flow path of refrigerant.

The following detailed description of the preferred embodiment is the preferred mode of carrying out the invention. The description is not to be taken in any limiting sense. It is presented for the purpose of illustrating the general principles of the present invention.

Referring to FIG. 4 to FIG. 7 of the drawings, a central air conditioning and heat pump system according to a first preferred embodiment of the present invention is illustrated. Broadly, the central air conditioning and heat pump system may comprise a plurality of connecting pipes 100, a main outdoor unit 1, and an indoor heat distribution system 2. A predetermined amount of refrigerant may circulate through the various components (described below) of the main outdoor unit 1 and the indoor heat distribution system 2. The refrigerant may circulate through the various components through a plurality of connecting pipes 100.

The main outdoor unit 1 may comprise at least one compressor 10 having a compressor outlet 101 and a compressor inlet 102, a refrigerant storage tank 20 having a liquid inlet 201 and a liquid outlet 202, a first outdoor heat exchanger 30, a cooling tower 40, and a switching valve 60.

The refrigerant storage tank 20 may be connected to the indoor heat distribution system 2 and the cooling tower 40. The first outdoor heat exchanger 30 may be connected to the compressor 10 through the switching valve 60. The first outdoor heat exchanger 30 may further be connected to the cooling tower 40 and the indoor heat distribution system 2.

The cooling tower 40 may comprise a water collection basin 41, a second outdoor heat exchanger 42 provided in the water collection basin 41, a fill material unit 43 provided underneath the water collection basin 41, and a water storage basin 44 provided underneath the fill material unit 43.

A predetermined amount of ambient air may be arranged to sequentially pass through the fill material unit 43 and the first outdoor heat exchanger 30. At the same time, a predetermined amount of cooling water may circulate between the water storage basin 44 and the water collection basin 41. The cooling water in water storage basin 44 may be arranged to be pumped to the water collection basin 41 for absorbing heat from the refrigerant flowing through the second outdoor heat exchanger 42. The water in the water collection basin 41 may be arranged to be distributed on the fill material unit 43 for releasing heat to the ambient air passing through the fill material unit 43. The cooling water may then be collected in the water storage basin 44 to complete one cooling cycle.

The indoor heat distribution system 2 may comprise at least one indoor heat exchanger 21 connected to the first outdoor heat exchanger 30, the cooling tower 40, and the compressor 10 through at least one of the connecting pipes 100 for allowing heat exchange between refrigerant and air in a designated indoor space.

The indoor heat distribution system 2 may further comprise a ventilating device 22, which may comprise a supporting frame 221, a ventilating heat exchanging unit 222, an energy efficient heat exchanger 223 and a centrifugal fan 224.

The supporting frame 221 may have an air intake opening 2211 exposed to ambient air for allowing intake of air through the air intake opening 2211.

The ventilating heat exchanging unit 222 may be supported in the supporting frame 221 and connected to the switching valve 60 and the first outdoor heat exchanger 30 through at least one of the connecting pipes 100, the ventilating heat exchanging unit 222 and the indoor heat exchanger 21 may be connected in parallel.

The energy efficient heat exchanger 223 may be supported in the supporting frame 221 at a position between the air intake opening 221 and the ventilating heat exchanging unit 222 such that the ambient air is arranged to pass through the energy efficient heat exchanger 223 before passing through the ventilating heat exchanging unit 222. The energy efficient heat exchanger 223 may be connected to the first outdoor heat exchanger 30, the second outdoor heat exchanger 42, and the refrigerant storage tank 20 through at least one of the connecting pipes 100.

The centrifugal fan 224 may be supported in the supporting frame 221 for drawing ambient air through the air intake opening 2211, and delivering fresh air to a predetermined indoor space.

The air conditioning and heat pump system may be selectively operated between an air conditioning mode and a heat pump mode, wherein in the air conditioning mode, the switching valve 60 may be switched such that a predetermined amount of vaporous refrigerant is arranged to leave the compressor and guided to enter the first outdoor heat exchanger 30 for releasing heat thereto, the refrigerant leaving the first outdoor heat exchanger 30 may be guided to flow through the second outdoor heat exchanger 42 for releasing heat to the cooling water circulating in the cooling tower 40, the refrigerant leaving the second outdoor heat exchanger 42 may be guided to flow through the indoor heat exchanger 21 of the indoor heat distribution system 2 for absorbing heat from the indoor heat exchanger 21, the refrigerant leaving the indoor heat exchanger 21 may be guided to flow through the switching valve 60 and flow back to the compressor to complete an air conditioning cycle.

When air conditioning and heat pump system is in the heat pump mode, the switching valve 60 may be switched such that a predetermined amount of vaporous refrigerant is arranged to leave the compressor 10 and guided to flow into the indoor heat exchanger 21 and the ventilating heat exchanging unit 222 for releasing heat to a designated indoor space and the ambient air drawn from the air intake opening 2211, the refrigerant leaving the indoor heat exchanger 21 and the ventilating heat exchanging unit 222 may be guided to flow through the energy efficient heat exchanger 223 for pre-heating the ambient air drawn from the air intake opening 2211. The refrigerant leaving the energy efficient heat exchanger 223 may be guided to flow through the first outdoor heat exchanger 30 for absorbing heat from ambient air passing therethrough. The refrigerant leaving the first outdoor heat exchanger 30 may be guided to pass through the switching valve 60 and flow back to the compressor 10 for completing a heat pump cycle.

Figure 4:
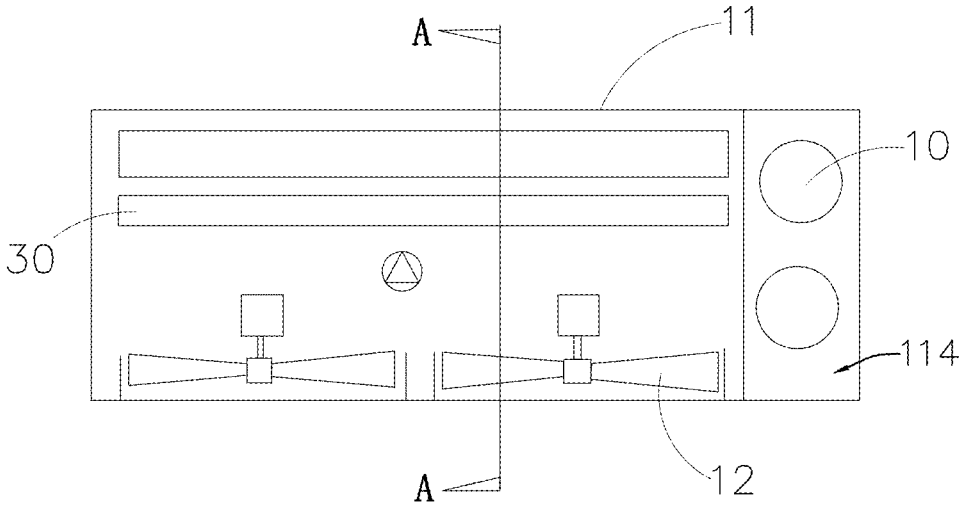
FIG. 4 is a schematic diagram of an outer main unit of an air conditioning and heat pump system according to a first preferred embodiment of the present invention.
Figure 5:
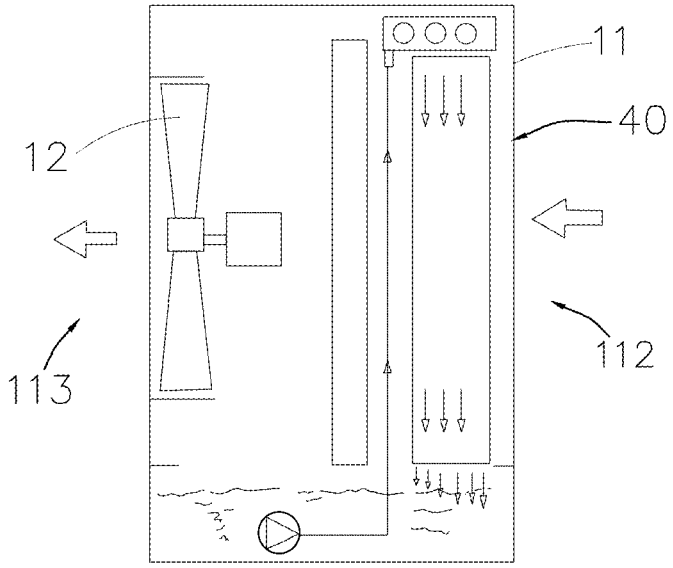
FIG. 5 is a sectional view along plane A-A of FIG. 4.
Figure 6:
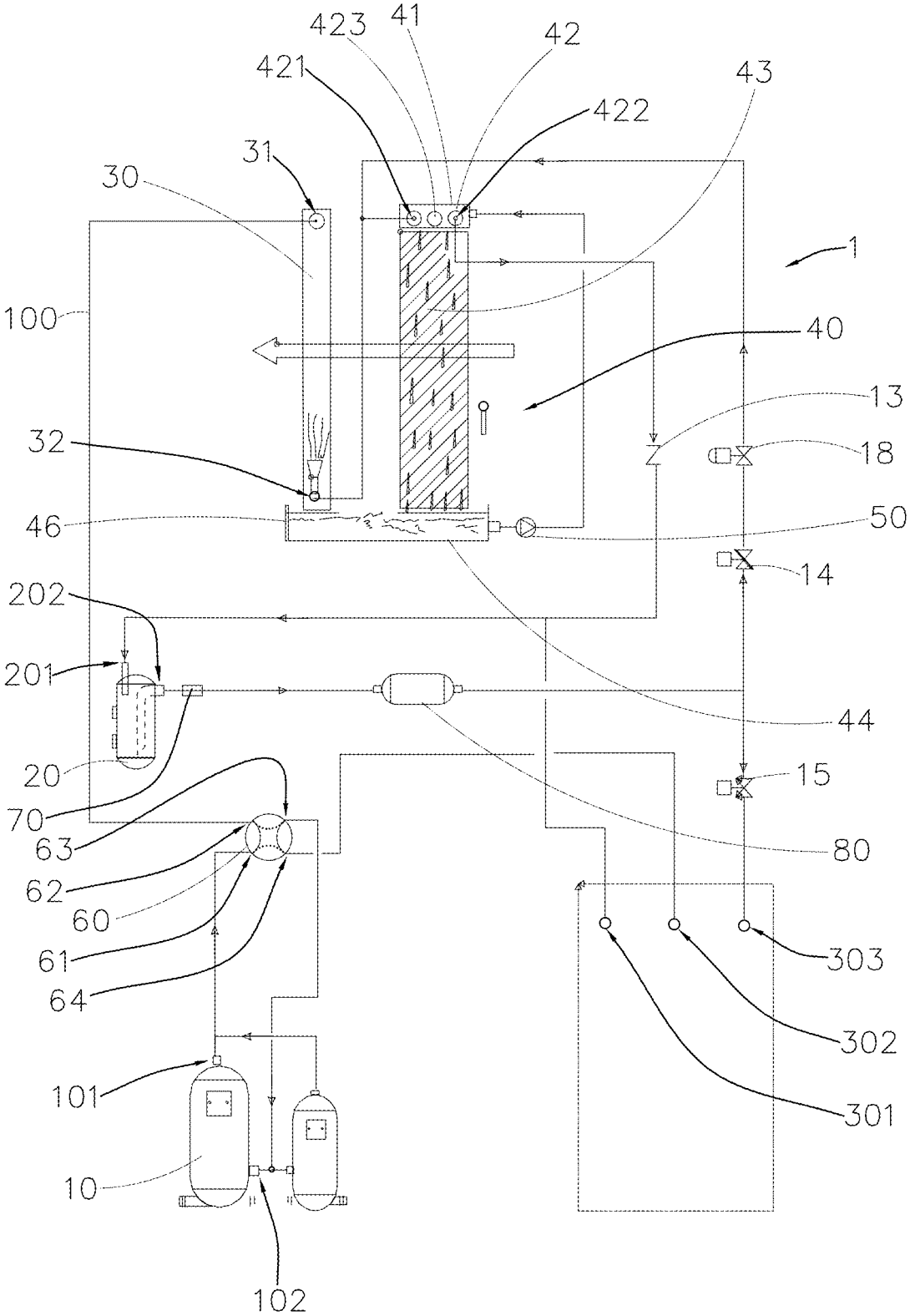
FIG. 6 is a schematic diagram of an air conditioning and heat pump system according to the first preferred embodiment of the present invention, illustrating a flow path of refrigerant.
Figure 7:
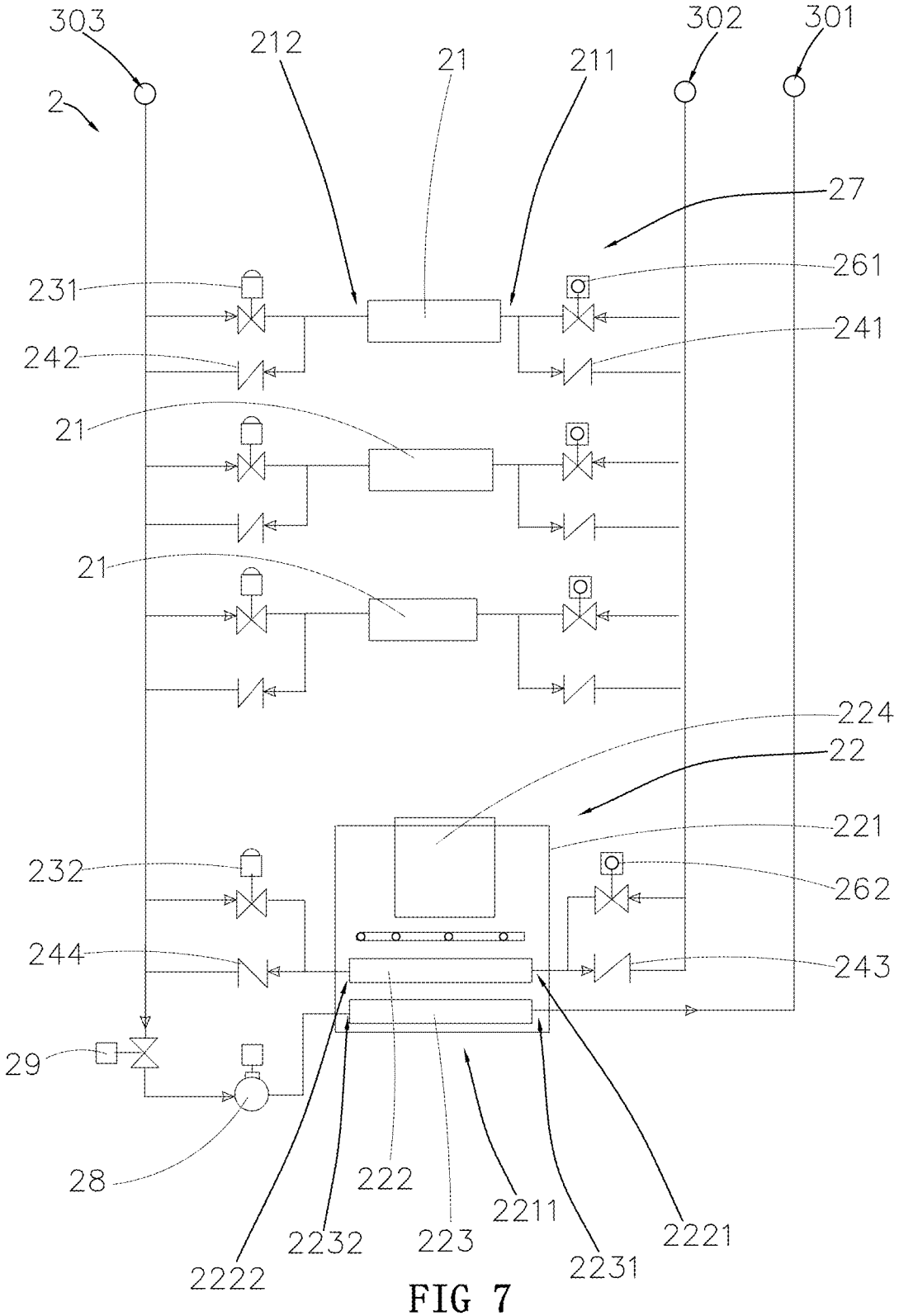
FIG. 7 is a schematic diagram of an indoor heat distribution system of the air conditioning and heat pump system according to the first preferred embodiment of the present invention.

The above-mentioned components may be connected to form a particular configuration to allow refrigerant to perform heat exchange with various mediums such as ambient air. An exemplary configuration is shown in FIG. 6 and FIG. 7 of the drawings. According to the first preferred embodiment of the present invention, the outdoor main unit 1 may be positioned on a roof of a building so that it may draw ambient air for performing heat exchange with the refrigerant. As shown in FIG. 4 to FIG. 5 of the drawings, the outdoor main unit 1 may further comprise a main casing 11 having a rectangular cross section when viewed from the top, wherein the main casing 11 may have an air inlet 112 and an air outlet 113. The air inlet 112 may be formed on at least one side of the main casing 11 while the air outlet 113 may be formed on an opposed side of the main casing 11.

The outdoor main unit 1 may further comprise at least one fan 12 provided adjacent to the air outlet 113 for drawing ambient air to flow from the air inlet 112 to the air outlet 113. The main casing 11 may further have a compressor compartment 114 for accommodating the compressor 10.

The switching valve 60 may have first through fourth connecting port 61, 62, 63, 64. The switching valve 60 may be switched between an air conditioning switching mode and a heat pump switching mode, wherein in the air conditioning switching mode, the switching valve 60 is switched such that the first connecting port 61 may be connected to the second connecting port 62 so that refrigerant may flow from the first connecting port 61 to the second connecting port 62, while the third connecting port 63 may be connected to the fourth connecting port 64 so that refrigerant may flow from the third connecting port 63 to the fourth connecting port 64.

In the heat pump switching mode, the switching valve 60 may be switched so that the first connecting port 61 may be connected to the fourth connecting port 64 so that refrigerant may flow from the first connecting port 61 to the fourth connecting port 64, while the second connecting port 62 may be connected to the third connecting port 63, so that refrigerant may flow from the second connecting port 62 to the third connecting port 63.

The first outdoor heat exchanger 30 may have a first communicating port 31 and a second communicating port 32 for allowing refrigerant to flow into or out of the first outdoor heat exchanger 30. As shown in FIG. 6 of the drawings, the first communicating port 31 may be connected to the second connecting port 62 of the switching valve 60. The second communicating port 32 may be connected to the second outdoor heat exchanger 42 of the cooling tower 40 in series. The refrigerant flowing through the first outdoor heat exchanger 30 may be arranged to perform heat exchange with the ambient air drawn from the air inlet 112 of the main casing 11.

The second outdoor heat exchanger 42 may have a first passage port 421 and a second passage port 422 for allowing refrigerant to flow into or out of the second outdoor heat exchanger 42. The first passage port 41 may be connected to the second communicating port 32 of the first outdoor heat exchanger 30. The second passage port 422 may be connected to the refrigerant storage tank 20 and the indoor heat distribution system 2 through various other auxiliary components (described below).

The second outdoor heat exchanger 42 may be provided in the water collection basin 41 of the water tower 40. Cooling water may be arranged to be collected in the water collection basin 41 in such a manner that the second outdoor heat exchanger 42 may be completely immersed in the cooling water for performing heat exchange therewith. The outdoor heat exchanger 42 may comprise a plurality of heat exchanging tubes 423 extended in the water collection basin 41. Refrigerant may pass through the heat exchanging tubes 423 for performing heat exchange with the cooling water.

The air conditioning and heat pump system may further comprise a refrigerant storage tank 20 having a liquid inlet 201 connected to the second passage port 422 of the second outdoor heat exchanger 42 and the indoor heat distribution system 2, and a liquid outlet 202 connected to the second communicating port 32 of the first outdoor heat exchanger 30, the first passage port 421 of the second outdoor heat exchanger 42, and the indoor heat distribution system 2.

The outdoor main unit 1 may further comprise a filter 80 connected to the liquid outlet 202 of the refrigerant storage tank 20. The outdoor main unit 1 may further comprise an expansion valve 18 connected between the filter 80 and the first passage port 421 second outdoor heat exchanger 42.

The outdoor main unit 1 may further comprise a unidirectional valve 13 for restricting the flow of the refrigerant in one predetermined direction. As shown in FIG. 6 of the drawings, the unidirectional valve 21 may be connected between the second passage port 422 of the second outdoor heat exchanger 42 and the liquid inlet 201 of the refrigerant storage tank 20. The unidirectional valve 21 may be configured to allow a flow of refrigerant only in a direction from the second outdoor heat exchanger 42 toward the refrigerant storage tank 20.

On the other hand, the refrigerant leaving the refrigerant storage tank 20 may be guided to flow through one of the two paths, the first path being toward the second communicating port 32 of the first outdoor heat exchanger 30 and the first passage port 421 of the second outdoor heat exchanger 42, the second path being toward the indoor heat distribution system 2.

The outdoor main unit 1 may further comprise a first electrically-controlled two-way valve 14 connected to the second communicating port 32 of the first outdoor heat exchanger 30, the first passage port 421 of the second outdoor heat exchanger 42, and the liquid outlet 202 of the refrigerant storage tank 20. Specifically, refrigerant coming from the liquid outlet 202 of the refrigerant storage tank 20 may be guided to flow through the filter 80, the first electrically-controlled two-way valve 14, the expansion valve 18, and to reach either the second communicating port 32 of the first outdoor heat exchanger 30 or the first passage port 421 of the second outdoor heat exchanger 42.

The main outdoor unit 1 may further comprise a second electrically-controlled two-way valve 15 connected to the indoor heat distribution system 2, and the liquid outlet 202 of the refrigerant storage tank 20. Refrigerant flowing from the liquid outlet 202 may be selectively guided to flow through the second electrically-controlled two-way valve 15 and reach the indoor heat distribution system 2. Each of the first electrically-controlled two-way valve 14 and the second electrically-controlled two-way valve 15 may be selectively switched off for not allowing refrigerant to pass therethrough. Each of the first electrically-controlled two-way valve 14 and the second electrically-controlled two-way valve 15 may also be selectively switched on for allowing refrigerant to pass therethrough in a predetermined direction.

The cooling tower 40 may be utilized to lower a temperature of the refrigerant flowing therethrough. The cooling tower 40 may further comprise a pump 50 for pumping cooling water from the water storage basin 44 back to the water collection basin 41. The cooling water in the water collection basin 41 may absorb heat from the second outdoor heat exchanger 42 and may then be guided to distribute on the fill material unit 43. The cooling water may form a thin film of water dropping down along a vertical direction of the fill material unit 43. At the same time, ambient air is drawn from the air inlet 112 to flow through the thin film of water in the fill material unit 43. The ambient air may then carry away the heat in the cooling water. After that, the cooling water may be collected in the water storage basin 44. The cooling water in the water collection basin 44 will be cooled and ready for being pumped back to the water collection basin 41 to start another cooling cycle.

It is worth mentioning that the cooling tower 40 may further comprise a water level sensor 46 provided in the water storage basin 44 while the outdoor main unit 1 may further comprise a temperature sensor 70 provided at the liquid outlet 202 of the refrigerant storage tank 20 for sensing a temperature of the refrigerant coming out from the refrigerant storage tank 20. The temperature sensor 70 and the water level sensor 46 may be connected to a control unit such that when a temperature of the refrigerant from the refrigerant storage tank 20 is below a predetermined threshold, the pump 45 will be turned off. Moreover, when the water level in the water storage basin 44 falls below a predetermined threshold (such as when public water supply is in shortage), the pump 45 will also be turned off.

As shown in FIG. 6 and FIG. 7 of the drawings, the outdoor main unit 1 and the indoor heat distribution system 2 may be communicated through first through third linkage ports 301, 302, 303. The first linkage port 301 may be connected to the liquid inlet 201 of the refrigerant storage tank 20 and the second passage port 422 of the second outdoor heat exchanger 42. The second linkage port 302 may be connected to the fourth connecting port 64 of the switching valve 60. The third linkage port 303 may be connected to the liquid outlet 202 of the refrigerant storage tank 20 through the second electrically-controlled two-way valve 15. The third linkage port 303 may also be connected to the first passage port 421 of the second outdoor heat exchanger 42 and the second communicating port 32 of the first outdoor heat exchanger 30.

These ports may serve as connection boundaries between the outdoor main unit 1 and the indoor heat distribution system 2. According to the first preferred embodiment of the present invention, the indoor heat distribution system 2 may further comprise a first indoor expansion valve 231, a first indoor unidirectional valve 241, a second indoor unidirectional valve 242, and a first indoor flow regulator 26 connected to the indoor heat exchanger 21 to form an indoor heat exchange configuration 27 as a group of components connected in a predetermined configuration. One The of such a configuration may be illustrated in FIG. 7 of the drawings. The indoor heat exchange configuration 27 may be connected between the second linkage port 302 and the third linkage port 303.

The indoor heat exchange configuration 27 may comprise the indoor heat exchanger 21, the first indoor expansion valve 231, the first indoor unidirectional valve 241, the second indoor unidirectional valve 242, and the first indoor flow regulator 261. The indoor heat exchanger 21 may have a first passing port 211 and a second passing port 212 which may serve as inlet or outlet of refrigerant. As shown in FIG. 7 of the drawings, the first passing port 211 may be connected to the second linkage port 302 while the second passing port 212 may be connected to the third linkage port 303. Specifically, the first indoor flow regulator 261 and the first indoor unidirectional valve 241 may be connected to the first passing port 211, and may be connected in parallel with each other. The first indoor flow regulator 261 and the first indoor unidirectional valve 241 may be connected to the second linkage port 302.

On the other hand, the first indoor expansion valve 231 and the second indoor unidirectional valve 242 may be connected to the second passing port 212, and may be connected in parallel with each other. The first indoor expansion valve 231 and the second indoor unidirectional valve 242 may be connected to the third linkage port 303.

The first indoor unidirectional valve 241 may be configured to allow flow of refrigerant from the first passing port 211 toward the second linkage port 302. The second indoor unidirectional valve 242 may be configured to allow flow of refrigerant from the second passing port 212 toward the third linkage port 303.

Note that the indoor heat distribution system 2 may actually comprise a plurality of indoor heat exchange configurations 27 connected in parallel. Each of the indoor heat exchange configurations 27 may have identical components and structure as mentioned above, and may provide conditioned or heated air to a designated indoor space, such as a room.

The indoor heat distribution system 2 may further comprise a third indoor unidirectional valve 243 and a fourth indoor unidirectional valve 244 connected to a first heat exchanging port 2221 and a second heat exchanging port 2222 of the ventilating heat exchanging unit 222 respectively. The first heat exchanging port 2221 and a second heat exchanging port 2222 may serve as an input or output port for refrigerant to enter or leave the ventilating heat exchanging unit 222. The ventilating heat exchanging unit 222 may be connected between the second linkage port 302 and the third linkage port 303. The third indoor unidirectional valve 243 may be configured to allow refrigerant to flow from the ventilating heat exchanging unit 222 toward the second linkage port 302. The fourth indoor unidirectional valve 244 may be configured to allow refrigerant to flow from the ventilating heat exchanging unit 222 toward the third linkage port 303.

The ventilating heat exchanging unit 222 may be configured as a heat exchanger and may have a plurality of heat exchanging tubes for performing heat exchange between refrigerant and the air passing therethrough.

The indoor heat distribution system 2 may further comprise a second indoor flow regulator 262 connected to the first heat exchanging port 2221 of the ventilating heat exchanging unit 222 and in parallel with the third indoor unidirectional valve 243. Moreover, the indoor heat distribution system 2 may further comprise a second expansion valve 232 connected to the second heat exchanging port 2222 of the ventilating heat exchanging unit 222 and in parallel with the fourth indoor unidirectional valve 244.

Moreover, the energy efficient heat exchanger 223 may have a first refrigerant passing port 2231 and a second refrigerant passing port 2232 which may serve as inlet or outlet of refrigerant. The indoor heat distribution system 2 may further comprise a depressurizing valve 28 connected to the second refrigerant passing port 2232 of the energy efficient heat exchanger 223 and to the third linkage port 303. The first refrigerant passing port 2231 may be connected to the first linkage port 301. The indoor heat distribution system 2 may further comprise an indoor electrically-controlled two-way valve 29 connected between the fourth indoor unidirectional valve 244 and the depressurizing valve 28.

Again, the energy efficient heat exchanger 223 may be configured as a heat exchanger and may have a plurality of heat exchanging tubes for performing heat exchange between refrigerant and the air passing therethrough.

In reality, the indoor heat distribution system 2 may comprise a plurality of indoor heat exchangers 21, wherein each of the indoor heat exchangers 21 may be arranged to provide conditioned or heated air or other medium in a designated indoor space (such as a room). On the other hand, a single ventilating device 22 may be provided to supply fresh air to several designated indoor spaces through a plurality of air ducts.

When the air conditioning and heat pump system is in the air conditioning mode, the switching valve 60 may be switched to the air conditioning switching mode. The first electrically-controlled two-way valve 14 may be turned off while the second electrically-controlled two-way valve 15 may be turned on.

Referring to FIG. 6 and FIG. 7 of the drawings, a predetermined amount of vaporous refrigerant is arranged to leave the compressor 10 through the compressor outlet 101 and may be guided to pass through the first connecting port 61, the second connecting port 62, and enter the first communicating port 31 of the first outdoor heat exchanger 30. The refrigerant may release heat to the ambient air passing through the first outdoor heat exchanger 30. The refrigerant leaving the first outdoor heat exchanger 30 through the second communicating port 32 may be guided to enter the second outdoor heat exchanger 42 through the first passage port 421. The refrigerant may further release heat to the cooling water stored in the water collection basin 41 and exit the second outdoor heat exchanger 42 through the second passage port 422 thereof. The refrigerant may then pass through the unidirectional valve 13 and enter the refrigerant storage tank 20 through the liquid inlet 201. The refrigerant may then leave the refrigerant storage tank 20 through the liquid outlet 202 and may be guided to flow through the filter 80, and the second electrically-controlled two-way valve 15, and enter the indoor heat distribution system 2 through the third linkage port 303.

The refrigerant may then be arranged to pass through the first indoor expansion valve 231 and enter the indoor heat exchanger 21 through the second passing port 212. The refrigerant may then absorb heat from the indoor space by performing heat exchange with another medium, such as air in the designated indoor space. The refrigerant may then leave the indoor heat exchanger 21 through the first passing port 211 and pass through the first indoor unidirectional valve 241 and may be guided to re-enter the outdoor main unit 1 through the second linkage port 302.

The refrigerant may then be guided to pass through the fourth connecting port 64 and the third connecting port 63 the switching valve 60, and eventually flow back to the compressor 101 through the compressor inlet 102 to complete an air conditioning cycle.

Note that when pump 45 is turned off due to low refrigerant temperature or low water level in the water storage basin 44, the refrigerant circulating in the air conditioning and heat pump system may be solely cooled by ambient air passing through the first outdoor heat exchanger 30.

Thus, when the air conditioning and heat pump system is operated in the air conditioning mode, the refrigerant may be cooled by ambient air and/or cooling water circulating in the cooling tower 40 depending on such environment factors as the temperature of the ambient air or the water level in the water storage basin 44.

When the air conditioning, air heating and water heating unit is in the heat pump mode, the switching valve 60 may be switched to the heat pump switching mode. The first electrically-controlled two-way valve 14 may be turned on while the second electrically-controlled two-way valve 15 may be turned off.

A predetermined amount of vaporous refrigerant is arranged to leave the compressor 10 through the compressor outlet 101 and may be guided to pass through the first connecting port 61 and the fourth connecting port 64 of the switching valve 60. The refrigerant may then be guided to enter the indoor heat distribution system 2 through the second linkage port 302.

In the indoor heat distribution system 2, the refrigerant may be arranged to pass through the first indoor flow regulator 261 and enter the indoor heat exchanger 21 through the first passing port 211 for releasing heat to the designated indoor space. The first indoor flow regulator 261 may determine the amount of refrigerant flowing into the indoor heat exchanger 21 so as to control the heat exchange performance (such as indoor temperature) between the indoor heat exchanger 21 and designated indoor space. The refrigerant may then be arranged to leave the indoor heat exchanger 21 through the second passing port 212 and pass through the second indoor unidirectional valve 242.

On the other hand, the refrigerant coming from the second linkage port 302 may also pass through the second indoor flow regulator 262 and enter the ventilating heat exchanging unit 222 through the first heat exchanging port 2221, because the ventilating heat exchanging unit 222 is connected in parallel with the indoor heat exchanger 21. The refrigerant may then release heat to the air passing through the ventilating heat exchanging unit 222. The heated air may then be delivered to the designated indoor space, through a plurality of air ducts, so as to supply fresh air to the designated indoor space.

Since the second electrically-controlled two-way valve 15 of the outdoor main unit 1 is turned off, and the indoor electrically-controlled two-way valve 29 of the indoor heat distribution system 2 is turned on, the refrigerant will be guided to pass through the depressurizing valve 28 and enter the energy efficient heat exchanger 223 through the second refrigerant passing port 2232 for releasing heat to the ambient air drawn from the air intake opening 2211. In other words, the ambient air will be pre-heated by the energy efficient heat exchanger 223.

The refrigerant may then be guided to leave the energy efficient heat exchanger 223 through the first refrigerant passing port 2231 and go back to the outdoor main unit 1 via the first linkage port 301. The refrigerant may then be guided to enter the refrigerant storage tank 20 through the liquid inlet 201. The refrigerant may then leave the refrigerant storage tank 20 through the liquid outlet 202 and may be guided to flow through the filter 80, the first electrically-controlled two-way valve 14, the expansion valve 18, and enter the first outdoor heat exchanger 30 through the second communicating port 32 for absorbing heat from the ambient air. The refrigerant may then be guided to leave the first outdoor heat exchanger 30 through the first communicating port 31 and pass through the second connecting port 62 of the switching valve 60, the third connecting port 63 of the switching valve 60, and eventually flow back to the compressor 10 through the compressor inlet 102 to complete a heat pump cycle.

Figure 8:
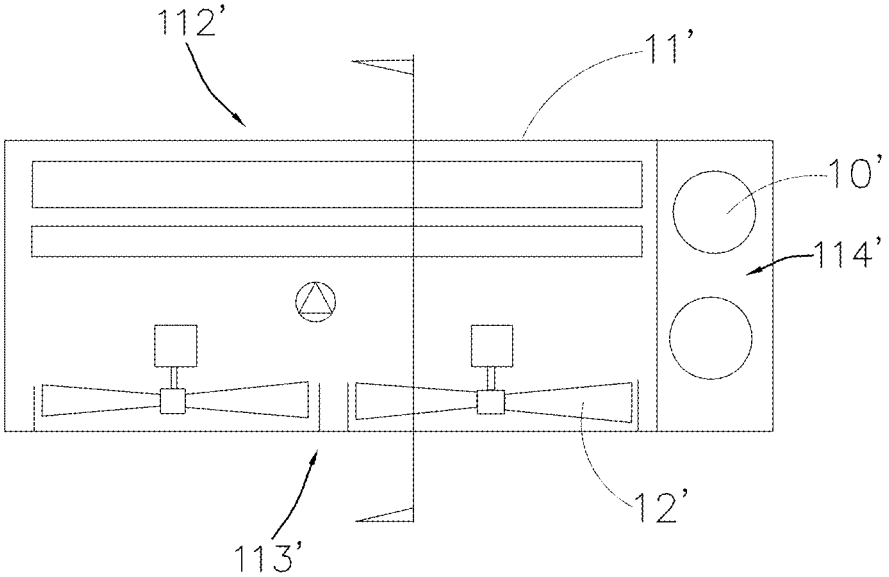
FIG. 8 is a schematic diagram of an outdoor main unit of an air conditioning and heat pump system according to a second preferred embodiment of the present invention.
Figure 9:
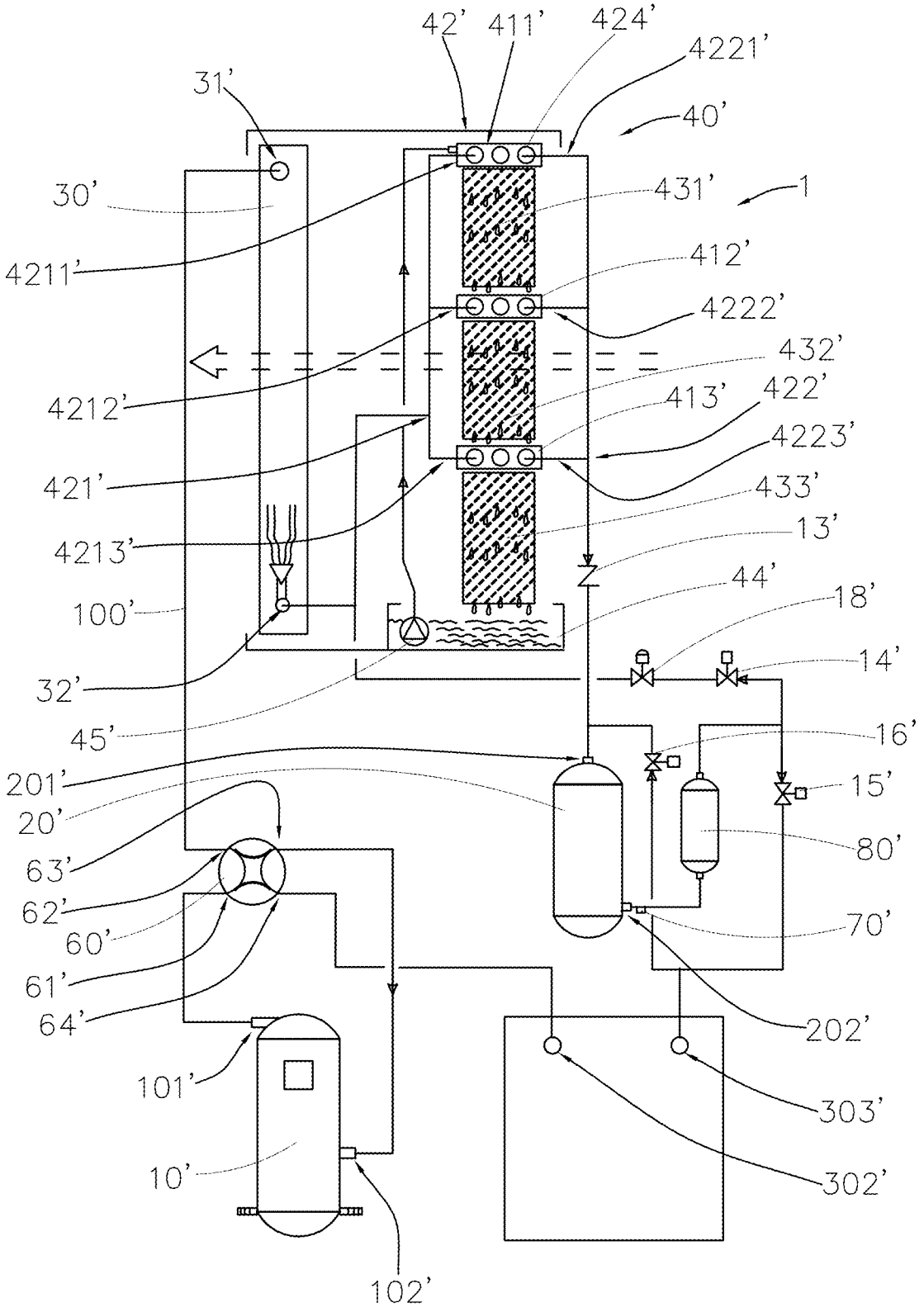
FIG. 9 is a schematic diagram of an indoor heat distribution system of the air conditioning and heat pump system according to the second preferred embodiment of the present invention.
Figure 10:
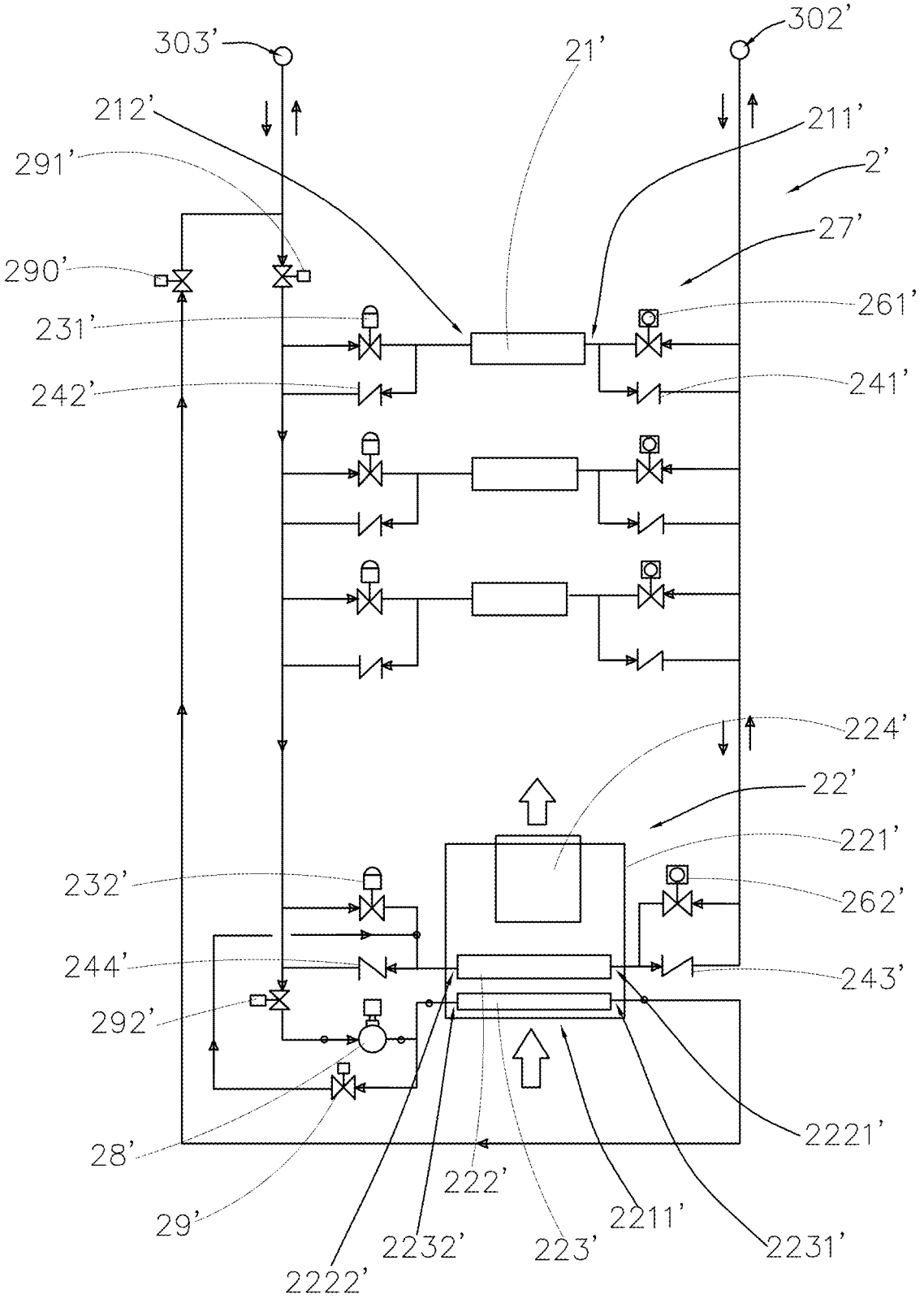
FIG. 10 is a schematic diagram of a main casing of the air conditioning and heat pump system according to the second preferred embodiment of the present invention.

Referring to FIG. 8 to FIG. 10 of the drawings, an air conditioning and heat pump system according to a second preferred embodiment of the present invention is illustrated. The second preferred embodiment is similar to the first preferred embodiment described above, except the cooling tower 40' and the configuration between the outdoor main unit 1' and the indoor heat distribution system 2'.

According to the second preferred embodiment, the central air conditioning and heat pump system may comprise a plurality of connecting pipes 100', a main outdoor unit 1', and an indoor heat distribution system 2'. A predetermined amount of refrigerant may circulate through the various components of the main outdoor unit 1' and the indoor heat distribution system 2'. The refrigerant may circulate through the various components through a plurality of connecting pipes 100'.

The main outdoor unit 1' may comprise at least one compressor 10' having a compressor outlet 101' and a compressor inlet 102', a refrigerant storage tank 20' having a liquid inlet 201' and a liquid outlet 202', a first outdoor heat exchanger 30', a cooling tower 40', and a switching valve 60'.

The refrigerant storage tank 20' may be connected to the indoor heat distribution system 2' and the cooling tower 40' through a plurality of other components. The first outdoor heat exchanger 30' may be connected to the compressor 10' through the switching valve 60', the cooling tower 40', and the indoor heat distribution system 2'.

The cooling tower 40' may be configured as a multiple effect evaporative condenser, and may comprise first through third water collection basin 411', 412', 413', a water storage basin 44', a second outdoor heat exchanger 42' provided in the first water collection basin 411', the second water collection basin 412' and the third water collection basin 413', a first fill material unit 431' provided underneath the first water collection basin 411', a second fill material unit 432' provided underneath the second water collection basin 412', a third fill material unit 433' provided underneath the third water collection basin 413'. The water storage basin 44' may be provided underneath the third fill material unit 433'.

A predetermined amount of ambient air may be arranged to pass through the first through third fill material unit 431', 432', 433' and the first outdoor heat exchanger 30'. At the same time, a predetermined amount of cooling water may circulate between the water storage basin 44', the first through third water collection basin 411', 412', 413', and first through third fill material unit 431', 432', 433'. The cooling water in water storage basin 44' may be arranged to be pumped to the first water collection basin 411' for absorbing heat from the refrigerant flowing through the second outdoor heat exchanger 42'. The water in the water collection basin 41' may be arranged to be distributed on the first fill material unit 431' for releasing heat to the ambient air passing through them. The cooling water may then be collected in the second water collection basin 412' for absorbing heat from the second outdoor heat exchanger 42'. The cooling water may then go on to flow down to the second fill material unit 432' so that the cooling water may be cooled by the ambient air passthrough therethrough. The cooling water may then be collected in the third water collection basin 413' for absorbing heat from the second outdoor heat exchanger 42'. The cooling water may then go on to flow down to the third fill material unit 433' so that the cooling water may be cooled by the ambient air passthrough therethrough. Eventually, the cooling water may then be collected in the water storage basin 44' to complete one cooling cycle.

The indoor heat distribution system 2' may comprise at least one indoor heat exchanger 21' connected to the first outdoor heat exchanger 30', the cooling tower 40', and the compressor 10' through at least one of the connecting pipes 100' for allowing heat exchange between refrigerant and air in a designated indoor space.

The indoor heat distribution system 2' may further comprise a ventilating device 22', which may comprise a supporting frame 221', a ventilating heat exchanging unit 222', an energy efficient heat exchanger 223' and a centrifugal fan 224'.

The supporting frame 221' may have an air intake opening 2211' exposed to ambient air for allowing intake of air through the air intake opening 2211'.

The ventilating heat exchanging unit 222' may be supported in the supporting frame 221' and connected to the switching valve 60', the cooling tower 40', the first outdoor heat exchanger 30' and the refrigerant storage tank 20' through at least one of the connecting pipes 100' and other auxiliary components. The ventilating heat exchanging unit 222' and the indoor heat exchanger 21' may be connected in parallel, as shown in FIG. 10 of the drawings.

The energy efficient heat exchanger 223' may be supported in the supporting frame 221' at a position between the air intake opening 221' and the ventilating heat exchanging unit 222' such that the ambient air is arranged to pass through the energy efficient heat exchanger 223' before passing through the ventilating heat exchanging unit 222'. The energy efficient heat exchanger 223' may be connected to the first outdoor heat exchanger 30', the cooling tower 40' and the refrigerant storage tank 20' through at least one of the connecting pipes 100' and other auxiliary components.

The centrifugal fan 224' may be supported in the supporting frame 221' for drawing ambient air through the air intake opening 2211', and delivering fresh air to a predetermined indoor space.

The air conditioning and heat pump system may be selectively operated between an air conditioning mode and a heat pump mode, wherein in the air conditioning mode, the switching valve 60' may be switched such that a predetermined amount of vaporous refrigerant is arranged to leave the compressor 10' and guided to enter the first outdoor heat exchanger 30' for releasing heat thereto, the refrigerant leaving the first outdoor heat exchanger 30' may be guided to flow through the second outdoor heat exchanger 42' for releasing heat to the cooling water circulating in the cooling tower 40', the refrigerant leaving the second outdoor heat exchanger 42' may be guided to flow through the indoor heat exchanger 21' of the indoor heat distribution system 2' for absorbing heat from the indoor heat exchanger 21', the refrigerant leaving the indoor heat exchanger 21' may be guided to flow through the switching valve 60' and flow back to the compressor 10' to complete an air conditioning cycle.

When the air conditioning and heat pump system is in the heat pump mode, the switching valve 60' may be switched such that a predetermined amount of vaporous refrigerant is arranged to leave the compressor 10' and guided to flow into the indoor heat exchanger 21' and the ventilating heat exchanging unit 222' for releasing heat to a designated indoor space and the ambient air drawn from the air intake opening 2211', the refrigerant leaving the indoor heat exchanger 21' and the ventilating heat exchanging unit 222' may be guided to flow through the energy efficient heat exchanger 223' for pre-heating the ambient air drawn from the air intake opening 2211'. The refrigerant leaving the energy efficient heat exchanger 223' may be guided to flow through the first outdoor heat exchanger 30' for absorbing heat from ambient air passing therethrough. The refrigerant leaving the first outdoor heat exchanger 30' may be guided to pass through the switching valve 60' and flow back to the compressor for completing a heat pump cycle.

The above-mentioned components may be connected to form a particular configuration to allow refrigerant to perform heat exchange with various mediums such as ambient air. An exemplary configuration is shown in FIG. 9 and FIG. 10 of the drawings. According to the second preferred embodiment of the present invention, the outdoor main unit 1' may be positioned on a roof of a building so that it may draw ambient air for performing heat exchange with the refrigerant. As shown in FIG. 10 of the drawings, the outdoor main unit 1' may further comprise a main casing 11' having a rectangular cross section when viewed from the top, wherein the main casing 11' may have an air inlet 112' and an air outlet 113'. The air inlet 112' may be formed on at least one side of the main casing 11' while the air outlet 113' may be formed on an opposed side of the main casing 11'.

The outdoor main unit 1' may further comprise at least one fan 12' provided adjacent to the air outlet 113' for drawing ambient air to flow from the air inlet 112' to the air outlet 113'. The main casing 11' may further have a compressor compartment 114' for accommodating the compressor 10'.

The switching valve 60' may have first through fourth connecting port 61', 62', 63', 64'. The switching valve 60' may be switched between an air conditioning switching mode and a heat pump switching mode, wherein in the air conditioning switching mode, the switching valve 60' is switched such that the first connecting port 61' may be connected to the second connecting port 62' so that refrigerant may flow from the first connecting port 61' to the second connecting port 62', while the third connecting port 63' may be connected to the fourth connecting port 64' so that refrigerant may flow from the third connecting port 63' to the fourth connecting port 64'.

In the heat pump switching mode, the switching valve 60' may be switched so that the first connecting port 61' may be connected to the fourth connecting port 64' so that refrigerant may flow from the first connecting port 61' to the fourth connecting port 64', while the second connecting port 62' may be connected to the third connecting port 63', so that refrigerant may flow from the second connecting port 62' to the third connecting port 63'.

The first outdoor heat exchanger 30' may have a first communicating port 31' and a second communicating port 32' for allowing refrigerant to flow into or out of the first outdoor heat exchanger 30'. As shown in FIG. 9 of the drawings, the first communicating port 31' may be connected to the second connecting port 62' of the switching valve 60'. The second communicating port 32' may be connected to the second outdoor heat exchanger 42' of the cooling tower 40'. The refrigerant flowing through the first outdoor heat exchanger 30' may be arranged to perform heat exchange with the ambient air drawn from the air inlet 112' of the main casing 11'.

The second outdoor heat exchanger 42' may have a first passage port 421' and a second passage port 422' for allowing refrigerant to flow into or out of the second outdoor heat exchanger 42'. The first passage port 421' may be connected to the second communicating port 32' of the first outdoor heat exchanger 30'. The second passage port 422' may be connected to the refrigerant storage tank 20' through various other auxiliary components (described below). As shown in FIG. 9 of the drawings, the first passage port 421' may be connected to three input branches 4211', 4212', 4213' each connecting to the relevant sections of the second outdoor heat exchanger 42'. Similarly, refrigerant passing through the second outdoor heat exchanger 42' may be guided to leave through three output branches 4221', 4222', 4223' which may eventually merge to a single second passage port 422'.

The second outdoor heat exchanger 42' may comprise a plurality of heat exchanging tubes 424' immersed into first through third water collection basin 411', 412', 413' respectively. The heat exchanging tubes 424' in the first through third water collection basin 411', 412', 413' may be connected to the three input branches 4211', 4212', 4213' and the three output branches 4221', 4222', 4223' respectively. Cooling water may be arranged to be collected in the first through third water collection basin 411', 412', 413' in such a manner that the second outdoor heat exchanger 42' may be completely immersed in the cooling water for performing heat exchange therewith.

The air conditioning and heat pump system may further comprise a refrigerant storage tank 20' having an liquid inlet 201' connected to the second passage port 422' of the second outdoor heat exchanger 42' and the indoor heat distribution system 2', and a liquid outlet 202' connected to the second communicating port 32' of the first outdoor heat exchanger 30', the first passage port 421' of the second outdoor heat exchanger 42', and the indoor heat distribution system 2' through various auxiliary components.

The outdoor main unit 1 may further comprise a filter 80' connected to the liquid outlet 202' of the refrigerant storage tank 20'. The outdoor main unit 1' may further comprise an expansion valve 18' connected to the second communicating port 32' of the first outdoor heat exchanger 30'.

The outdoor main unit 1 may further comprise a unidirectional valve 13' for restricting the flow of the refrigerant in one predetermined direction. As shown in FIG. 9 of the drawings, the unidirectional valve 13' may be connected between the second passage port 422' of the second outdoor heat exchanger 42' and the liquid inlet 201' of the refrigerant storage tank 20'. The unidirectional valve 13' may be configured to allow a flow of refrigerant in a direction from the second outdoor heat exchanger 42' toward the refrigerant storage tank 20'.

On the other hand, the refrigerant leaving the refrigerant storage tank 20' may be guided to flow to the filter 80'. The refrigerant leaving the filter 80' may be guided to flow through one of the two paths, the first path being toward the second communicating port 32' of the first outdoor heat exchanger 30', the second path being toward the indoor heat distribution system 2'.

The outdoor main unit 1' may further comprise a first electrically-controlled two-way valve 14' connected to the second communicating port 32' of the first outdoor heat exchanger 30', the first passage port 421' of the second outdoor heat exchanger 42', and the liquid outlet 202' of the refrigerant storage tank 20'. Specifically, refrigerant coming from the liquid outlet 202' of the refrigerant storage tank 20' may be guided to flow through the filter 80', the first electrically-controlled two-way valve 14', the expansion valve 18', and reach either the second communicating port 32' of the first outdoor heat exchanger 30' or the first passage port 421' of the second outdoor heat exchanger 42'. This is one of the paths for the refrigerant coming out from the refrigerant storage tank 20'.

The main outdoor unit 1' may further comprise a second electrically-controlled two-way valve 15' connected to the indoor heat distribution system 2', and the liquid outlet 202' of the refrigerant storage tank 20'. Refrigerant flowing from the liquid outlet 202' may be selectively guided to flow through the second electrically-controlled two-way valve 15' and reach the indoor heat distribution system 2'. This is the other path for the refrigerant coming out from the refrigerant storage tank 20'.

Each of the first electrically-controlled two-way valve 14' and the second electrically-controlled two-way valve 15' may be selectively switched off for not allowing refrigerant to pass therethrough. It is when they are switched on that the refrigerant may be allowed to pass through.

The main outdoor unit 1' may further comprise a third electrically-controlled two-way valve 16' connected to the indoor heat distribution system 2', and the liquid inlet 201' of the refrigerant storage tank 20'. The third electrically-controlled two-way valve 16' may allow refrigerant to flow from the indoor heat distribution system 2' toward the liquid inlet 201' of the refrigerant storage tank 20'.

The cooling tower 40' may be utilized to lower a temperature of the refrigerant flowing therethrough. The cooling tower 40' may further comprise a pump 45' for pumping cooling water from the water storage basin 44' back to the first water collection basin 411'.

The cooling water in the first through third water collection basins 411', 412', 413' may absorb heat from the second outdoor heat exchanger 42' and may then be guided to distribute on the first through third fill material units 431', 432', 433' in the manner described above. The cooling water may form a thin film of water dropping down along a vertical direction of the first through third fill material unit 431', 432', 433'. At the same time, ambient air is drawn from the air inlet 112' to flow through the thin film of water in first through third fill material unit 431', 432', 433'. The ambient air may then carry away the heat in the cooling water. After that, the cooling water may be collected in the water storage basin 44'. The cooling water in the water collection basin 44' will be cooled and ready for being pumped back to the water collection basin 41' to start another cooling cycle.

It is worth mentioning that the outdoor main unit 1' may further comprise a temperature sensor 70' provided at the liquid outlet 202' of the refrigerant storage tank 20' for sensing a temperature of the refrigerant coming out from the refrigerant storage tank 20'. The temperature sensor 70' may be connected to a control unit such that when a temperature of the refrigerant from the refrigerant storage tank 20' is below a predetermined threshold, the pump device 45' will be turned off.

As shown in FIG. 9 and FIG. 10 of the drawings, the outdoor main unit 1' and the indoor heat distribution system 2' may be communicated via second through third linkage ports 302', 303'. The second linkage port 302' may be connected to the fourth connecting port 64' of the switching valve 60'. The third linkage port 303' may be connected to the liquid inlet 201' of the refrigerant storage tank 20' and the second passage port 422' of the second outdoor heat exchanger 42' through the third electrically-controlled two-way valve 16'. Moreover, the third linkage port 303' may also be connected to the first passage port 421' of the second outdoor heat exchanger 42' and the second communicating port 32' of the first outdoor heat exchanger 30' through other components (described below).

These ports may serve as connection boundaries between the outdoor main unit 1' and the indoor heat distribution system 2'. According to the second preferred embodiment of the present invention, the indoor heat distribution system 2' may further comprise a first indoor expansion valve 231', a first indoor unidirectional valve 241', a second indoor unidirectional valve 242', and a first indoor flow regulator 261' connected to the indoor heat exchanger 21' to form an indoor heat exchange configuration 27' as a group of components connected in a predetermined configuration. One of such a configuration may be illustrated in FIG. 10 of the drawings. The indoor heat exchange configuration 27' may be connected between the second linkage port 302' and the third linkage port 303'.

The indoor heat exchange configuration 27' may comprise the indoor heat exchanger 21', the first indoor expansion valve 231', the first indoor unidirectional valve 241', the second indoor unidirectional valve 242', and the first indoor flow regulator 261'. The indoor heat exchanger 21' may have a first passing port 211' and a second passing port 212' which may serve as inlet or outlet of refrigerant. As shown in FIG. 10 of the drawings, the first passing port 211' may be connected to the second linkage port 302' while the second passing port 212' may be connected to the third linkage port 303'. Specifically, the first indoor flow regulator 261' and the first indoor unidirectional valve 241' may be connected to the first passing port 211', and may be connected in parallel with each other. The first indoor flow regulator 261' and the first indoor unidirectional valve 241' may be connected to the second linkage port 302'.

On the other hand, the first indoor expansion valve 231' and the second indoor unidirectional valve 242' may be connected to the second passing port 212' and may be connected in parallel with each other. The first indoor expansion valve 231' and the second indoor unidirectional valve 242' may be connected to the third linkage port 303'.

The first indoor unidirectional valve 241' may be configured to allow flow of refrigerant from the first passing port 211' toward the second linkage port 302'. The second indoor unidirectional valve 242' may be configured to allow flow of refrigerant from the second passing port 212' toward the third linkage port 303'.

Note that, as in the first preferred embodiment, the indoor heat distribution system 2' may actually comprise a plurality of indoor heat exchange configurations 27' connected in parallel. Each of the indoor heat exchange configurations 27' may have identical components and structure as mentioned above, and may provide conditioned or heated air to a designated indoor space, such as a room.

The indoor heat distribution system 2' may further comprise a third indoor unidirectional valve 243' and a fourth indoor unidirectional valve 244' connected to a first heat exchanging port 2221' and a second heat exchanging port 2222' of the ventilating heat exchanging unit 222' respectively. The first heat exchanging port 2221' and a second heat exchanging port 2222' may serve as an input or output port for refrigerant to enter or leave the ventilating heat exchanging unit 222'. The ventilating heat exchanging unit 222' may be connected between the second linkage port 302' and the third linkage port 303'. The third indoor unidirectional valve 243' may be configured to allow refrigerant to flow from the ventilating heat exchanging unit 222' toward the second linkage port 302'. The fourth indoor unidirectional valve 244' may be configured to allow refrigerant to flow from the ventilating heat exchanging unit 222' toward the third linkage port 303'.

The ventilating heat exchanging unit 222' may be configured as a heat exchanger having a plurality of heat exchanging tubes for performing heat exchange between refrigerant and the air passing therethrough.

The indoor heat distribution system 2' may further comprise a second indoor flow regulator 262' connected to the first heat exchanging port 2221' of the ventilating heat exchanging unit 222' and in parallel with the third indoor unidirectional valve 243'. Moreover, the indoor heat distribution system 2' may further comprise a second expansion valve 232' connected to the second heat exchanging port 2222' of the ventilating heat exchanging unit 222' and in parallel with the fourth indoor unidirectional valve 244'.

Moreover, the energy efficient heat exchanger 223' may have a first refrigerant passing port 2231' and a second refrigerant passing port 2232' which may serve as inlet or outlet of refrigerant. The indoor heat distribution system 2' may further comprise a depressurizing valve 28' connected to the second refrigerant passing port 2232' of the energy efficient heat exchanger 223' and to the third linkage port 303'. The first refrigerant passing port 2231' may be connected to the third linkage port 303' through a second indoor electrically-controlled two-way valve 290'. The indoor heat distribution system 2' may further comprise a first indoor electrically-controlled two-way valve 29' connected to the second refrigerant passing port 2232' and in parallel with the depressurizing valve 28'.

The second refrigerant passing port 2232' may also be connected to the second heat exchanging port 2222' through the first indoor electrically-controlled two-way valve 29'.

The indoor heat distribution system 2' may further comprise a third indoor electrically-controlled two-way valve 291' and a fourth indoor electrically-controlled two-way valve 292'. The third indoor electrically-controlled two-way valve 291' may be connected in parallel with the second indoor electrically-controlled two-way valve 290'.

Again, the energy efficient heat exchanger 223' may be configured as having a plurality of heat exchanging tubes for performing heat exchange between refrigerant and the air passing therethrough.

In reality, the indoor heat distribution system 2' may comprise a plurality of indoor heat exchangers 21', wherein each of the indoor heat exchangers 21' may be arranged to provide conditioned or heated air or other medium in a designated indoor space (such as a room). On the other hand, a single ventilating device 22' may be provided to supply fresh air to several designated indoor spaces through a plurality of air ducts.

When the air conditioning and heat pump system is in the air conditioning mode, the switching valve 60' may be switched to the air conditioning switching mode. The first electrically-controlled two-way valve 14' may be turned off while the second electrically-controlled two-way valve 15' may be turned on.

Referring to FIG. 9 and FIG. 10 of the drawings, a predetermined amount of vaporous refrigerant is arranged to leave the compressor 10' through the compressor outlet 101' and may be guided to pass through the first connecting port 61', the second connecting port 62', and enter the first communicating port 31' of the first outdoor heat exchanger 30'. The refrigerant may release heat to the ambient air passing through the first outdoor heat exchanger 30'. The refrigerant leaving the first outdoor heat exchanger 30' through the second communicating port 32' may be guided to enter the second outdoor heat exchanger 42' through the first passage port 421' and the three input branches 4211', 4212', 4213'. The refrigerant may further release heat to the cooling water stored in the first through third water collection basin 411', 412', 413' and exit the second outdoor heat exchanger 42' through the second passage port 422' and the three output branches 4221', 4222, 4213' thereof. The refrigerant may then pass through the unidirectional valve 13' and enter the refrigerant storage tank 20' through the liquid inlet 201'. The refrigerant may then leave the refrigerant storage tank 20' through the liquid outlet 202' and may be guided to flow through the filter 80', and the second electrically-controlled two-way valve 15', and enter the indoor heat distribution system 2' through the third linkage port 303'.

The refrigerant may then be arranged to pass through the third indoor electrically-controlled two-way valve 291' and the first indoor expansion valve 231' and enter the indoor heat exchanger 21' through the second passing port 212'. The refrigerant may then absorb heat from the indoor space by performing heat exchange with another medium, such as air in the designated indoor space. The refrigerant may then leave the indoor heat exchanger 21' through the first passing port 211' and pass through the first indoor unidirectional valve 241' and may be guided to re-enter the outdoor main unit 1' through the second linkage port 302'.

The refrigerant may then be guided to pass through the fourth connecting port 64' and the third connecting port 63' the switching valve 60', and eventually flow back to the compressor 10' through the compressor inlet 102' to complete an air conditioning cycle.

Note that when pump 45' is turned off due to low refrigerant temperature in the water storage basin 44', the refrigerant circulating in the air conditioning and heat pump system may be solely cooled by ambient air passing through the first outdoor heat exchanger 30'.

Thus, when the air conditioning and heat pump system is operated in the air conditioning mode, the refrigerant may be cooled by ambient air and/or cooling water circulating in the cooling tower 40' depending on such environment factors as the temperature of the ambient air or the water level in the water storage basin 44'.

It is worth mentioning that the purpose of first indoor electrically-controlled two-way valve 29' is to allow residual refrigerant from the energy efficient heat exchanger 223' to flow back to the compressor 10' in the air conditioning mode because the energy efficient heat exchanger 223' may become idle when the air conditioning and heat pump system is operated in the air conditioning mode. In the air conditioning mode, the first indoor electrically-controlled two-way valve 29' may be opened while the second indoor electrically-controlled two-way valve 290' and the fourth indoor electrically-controlled two-way valve 292' may be closed. The residual refrigerant in the energy efficient heat exchanger 223' may be allowed to pass through the first indoor electrically-controlled two-way valve 29' and enter the ventilating heat exchanging unit 222' through the second heat exchanging port 2222'. The residual refrigerant leaving the ventilating heat exchanging unit 222' through the first heat exchanging port 2221' may pass through the third indoor unidirectional valve 243' and return to the outdoor main unit 1' through the second linkage port 302'. The residual refrigerant may be guided to pass through the fourth connecting port 64', the third connecting port 63' and go back to the compressor 10'.

When the air conditioning, air heating and water heating unit is in the heat pump mode, the switching valve 60' may be switched to the heat pump switching mode. The first electrically-controlled two-way valve 14' may be opened (turned on) while the second electrically-controlled two-way valve 15' may be closed (turned off).

A predetermined amount of vaporous refrigerant is arranged to leave the compressor 10' through the compressor outlet 101' and may be guided to pass through the first connecting port 61' and the fourth connecting port 64' of the switching valve 60'. The refrigerant may then be guided to enter the indoor heat distribution system 2' through the second linkage port 302'.

In the indoor heat distribution system 2', the refrigerant may be arranged to pass through the first indoor flow regulator 261' and enter the indoor heat exchanger 21' through the first passing port 211' for releasing heat to the designated indoor space. On the other hand, some refrigerant may also pass through the second indoor flow regulator 262' and enter the ventilating heat exchanging unit 222' through the first heat exchanging port 2221'.

The first indoor flow regulator 261' may determine the amount of refrigerant flowing into the indoor heat exchanger 21' so as to control the heat exchange performance (such as indoor temperature) between the indoor heat exchanger 21' and designated indoor space. The second indoor flow regulator 262' may determine the amount of refrigerant flowing into the ventilating heat exchanging unit 222' so as to control the heat exchange performance (such as indoor temperature) between the ventilating heat exchanging unit 222' and ambient air from the air intake opening 2211'.

The refrigerant may then be arranged to leave the indoor heat exchanger 21' through the second passing port 212' and pass through the second indoor unidirectional valve 242'. The refrigerant in the ventilating heat exchanging unit 222' may then be arranged to leave the ventilating heat exchanging unit 222' through the second heat exchanging port 2222' and pass through the fourth indoor unidirectional valve 244'.

In this heat pump mode, the third indoor electrically-controlled two-way valve 291' may be closed while the fourth indoor electrically-controlled two-way valve 292' may be opened. The refrigerant passing through the second indoor unidirectional valve 242' and the fourth indoor unidirectional valve 244' may then merge and be guided to pass through the fourth indoor electrically-controlled two-way valve 292' and the depressurizing valve 28' and enter the energy efficient heat exchanger 223' for releasing heat to the ambient air drawn from the air intake opening 2211'. In other words, the ambient air will be pre-heated by the energy efficient heat exchanger 223'. The first indoor electrically-controlled two-way valve 29' may be closed at this time.

The refrigerant may then be guided to leave the energy efficient heat exchanger 223' through the first refrigerant passing port 2231' and pass through the second indoor electrically-controlled two-way valve 290' (which may be opened) and go back to the outdoor main unit 1' via the third linkage port 303'.

In the outdoor main unit 1', the second electrically-controlled two-way valve 15' may be closed while the third electrically-controlled two-way valve 16' and the first electrically-controlled two-way valve 14' may be opened. The refrigerant may then be guided to pass through the third electrically-controlled two-way valve 16' (which may be opened) and enter the refrigerant storage tank 20' through the liquid inlet 201'. The refrigerant may then leave the refrigerant storage tank 20' through the liquid outlet 202' and may be guided to flow through the filter 80', the first electrically-controlled two-way valve 14', the expansion valve 18', and enter the first outdoor heat exchanger 30' through the second communicating port 32' for absorbing heat from the ambient air. The refrigerant may then be guided to leave the first outdoor heat exchanger 30' through the first communicating port 31' and pass through the second connecting port 62' of the switching valve 60', the third connecting port 63' of the switching valve 60', and eventually flow back to the compressor 10' through the compressor inlet 102' to complete a heat pump cycle.

The present invention, while illustrated and described in terms of the preferred embodiments and several alternatives, is not limited to the particular description contained in this specification. Additional alternative or equivalent components could also be used to practice the present invention.

What is claimed is:

1. An air conditioning and heat pump system, comprising:

a plurality of connecting pipes;

a main outdoor unit, which comprises:

a main casing having an air inlet and an air outlet;

at least one compressor supported in said main casing;

a refrigerant storage tank supported in said main casing;

a switching valve supported in said main casing;

a first outdoor heat exchanger supported in said main casing and connected to said compressor through said switching valve and at least one of said connecting pipes; and a cooling tower which is supported in said main casing, and comprises:

a first water collection basin;

a first fill material unit provided underneath said first water collection basin;

a second water collection basin provided underneath said first fill material unit;

a third water collection basin provided underneath said second water collection basin;

a third fill material unit provided underneath said third water collection basin;

a water storage basin provided underneath said third fill material unit;

a second outdoor heat exchanger provided in said first water collection basin, said second water collection basin and said third water collection basin; and a pump connected between said water storage basin and said first through third water collection basin, a predetermined amount of ambient air being arranged to pass through said first through third fill material unit and said first outdoor heat exchanger, a predetermined amount of cooling water circulating between said water storage basin, said first through third water collection basin, and first through third fill material unit, said cooling water in said water storage basin being arranged to be pumped to said first water collection basin for absorbing heat from said second outdoor heat exchanger therein, said water in said first water collection basin being arranged to be distributed on said first fill material unit, said cooling water being collected in said second water collection basin for absorbing heat from said second outdoor heat exchanger therein, said cooling water being arranged to flow down to said second fill material unit for being cooled by said ambient air, said cooling water being collected in said third water collection basin for absorbing heat from said second outdoor heat exchanger therein, said cooling water being arranged to flow down to said third fill material unit for being cooled by said ambient air, said cooling water being eventually collected in said water storage basin; and an indoor heat distribution system, which comprises:

at least one indoor heat exchanger connected to said first outdoor heat exchanger, said second outdoor heat exchanger of said cooling tower, and said compressor through at least one of said connecting pipes; and a ventilating device, which comprises:

a supporting frame having an air intake opening exposed to ambient air for allowing intake of air through said air intake opening;

a ventilating heat exchanging unit supported by said supporting frame, and connected to said refrigerant storage tank, said switching valve, and said first outdoor heat exchanger though at least one of said connecting pipes, said ventilating heat exchanging unit and said indoor heat exchanger being connected in parallel;

an energy efficient heat exchanger supported in said supporting frame at a position between said air intake opening and said ventilating heat exchanging unit such that said ambient air from said air intake opening is arranged to pass through said energy efficient heat exchanger before passing through said ventilating heat exchanging unit, said energy efficient heat exchanger being connected to said first outdoor heat exchanger, said second outdoor heat exchanger, and said refrigerant storage tank through at least one of said connecting pipes; and a centrifugal fan supported in said supporting frame, said air conditioning and heat pump system being selectively operated between an air conditioning mode and a heat pump mode, wherein in said air conditioning mode, said switching valve is switched such that a predetermined amount of vaporous refrigerant is arranged to leave said compressor and guided to enter said first outdoor heat exchanger for releasing heat thereto, said refrigerant leaving said first outdoor heat exchanger being guided to flow through said second outdoor heat exchanger for releasing heat to said cooling water circulating in said cooling tower, said refrigerant leaving said second outdoor heat exchanger being guided to flow through said indoor heat exchanger of said indoor heat distribution system for absorbing heat from said indoor heat exchanger, said refrigerant leaving said indoor heat exchanger being guided to flow through said switching valve and flow back to said compressor to complete an air conditioning cycle, wherein when said air conditioning and heat pump system is in said heat pump mode, said switching valve is switched such that a predetermined amount of vaporous refrigerant is arranged to leave said compressor and guided to flow into said indoor heat exchanger and said ventilating heat exchanging unit for releasing heat to a designated indoor space and said ambient air drawn from said air intake opening, said refrigerant leaving said indoor heat exchanger and said ventilating heat exchanging unit being guided to flow through said energy efficient heat exchanger for pre-heating said ambient air drawn from said air intake opening, said refrigerant leaving said energy efficient heat exchanger being guided to flow through said first outdoor heat exchanger for absorbing heat from ambient air passing therethrough, said refrigerant leaving said first outdoor heat exchanger being guided to pass through said switching valve and flow back to said compressor for completing a heat pump cycle.

2. The air conditioning and heat pump system, as recited in claim 1, wherein said switching valve has first through fourth connecting port, said switching valve being selectively switched between an air conditioning switching mode and a heat pump switching mode, wherein in said air conditioning switching mode, said switching valve is switched such that said first connecting port is connected to said second connecting port, while said third connecting port is connected to said fourth connecting port, wherein in said heat pump switching mode, said switching valve is switched so that said first connecting port is connected to said fourth connecting port, while said second connecting port is connected to said third connecting port.

3. The air conditioning and heat pump system, as recited in claim 2, wherein said first outdoor heat exchanger has a first communicating port and a second communicating port, said first communicating port being connected to said second connecting port of said switching valve, said second communicating port being connected to said second outdoor heat exchanger of said cooling tower.

4. The air conditioning and heat pump system, as recited in claim 3, wherein said second outdoor heat exchanger has a first passage port and a second passage port, said first passage port being connected to said second communicating port of said first outdoor heat exchanger, said second passage port being connected to said refrigerant storage tank, said second outdoor heat exchanger comprising a plurality of heat exchanging tubes immersed in said first through third water collection basin respectively, said heat exchanging tubes in said first through third water collection basin being connected to said first passage port and said second passage port.

5. The air conditioning and heat pump system, as recited in claim 4, wherein said refrigerant storage tank has a liquid inlet connected to said second passage port of said second outdoor heat exchanger and said indoor heat distribution system, and a liquid outlet connected to said second communicating port of said first outdoor heat exchanger, said first passage port of said second outdoor heat exchanger, and said indoor heat distribution system.

6. The air conditioning and heat pump system, as recited in claim 5, wherein said outdoor main unit further comprises a unidirectional valve connected between said second passage port of said second outdoor heat exchanger and said liquid inlet of said refrigerant storage tank, said unidirectional valve being configured to allow a flow of refrigerant only in a direction from said second outdoor heat exchanger toward said refrigerant storage tank.

7. The air conditioning and heat pump system, as recited in claim 6, wherein said outdoor main unit further comprises a first electrically-controlled two-way valve connected to said second communicating port of said first outdoor heat exchanger, said first passage port of said second outdoor heat exchanger, and said liquid outlet of said refrigerant storage tank.

8. The air conditioning and heat pump system, as recited in claim 7, wherein said main outdoor unit further comprises a second electrically-controlled two-way valve connected to said indoor heat distribution system, and said liquid outlet of said refrigerant storage tank.

9. The air conditioning and heat pump system, as recited in claim 8, wherein said main outdoor unit further comprises a third electrically-controlled two-way valve connected to said indoor heat distribution system, and said liquid inlet of said refrigerant storage tank, said third electrically-controlled two-way valve being configured to allow said refrigerant to flow in a direction from said indoor heat distribution system toward said liquid inlet of said refrigerant storage tank.

10. The air conditioning and heat pump system, as recited in claim 9, wherein said outdoor main unit and said indoor heat distribution system is communicated via second through third linkage ports, said second linkage port being connected to said fourth connecting port of said switching valve, said third linkage port being connected to said liquid inlet of said refrigerant storage tank and said second passage port of said second outdoor heat exchanger through said third electrically-controlled two-way valve, said third linkage port being further connected to said first passage port of said second outdoor heat exchanger and said second communicating port of said first outdoor heat exchanger.

11. The air conditioning and heat pump system, as recited in claim 10, wherein said indoor heat distribution system further comprises a first indoor expansion valve, a first indoor unidirectional valve, a second indoor unidirectional valve, and a first indoor flow regulator connected to said indoor heat exchanger to form an indoor heat exchange configuration, said indoor heat exchange configuration being connected between said second linkage port and said third linkage port.

12. The air conditioning and heat pump system, as recited in claim 11, wherein said indoor heat exchanger has a first passing port and a second passing port, said first indoor flow regulator and said first indoor unidirectional valve being connected to said first passing port, and connected in parallel with each other, said first indoor flow regulator and said first indoor unidirectional valve being connected to said second linkage port, said first indoor unidirectional valve being configured to allow flow of refrigerant in a direction only from said first passing port toward said second linkage port.

13. The air conditioning and heat pump system, as recited in claim 12, wherein said first indoor expansion valve and said second indoor unidirectional valve are connected to said second passing port, and connected in parallel with each other, said first indoor expansion valve and said second indoor unidirectional valve being connected to said third linkage port, said second indoor unidirectional valve being configured to allow flow of refrigerant in a direction only from said second passing port toward said third linkage port.

14. The air conditioning and heat pump system, as recited in claim 13, wherein said ventilating heat exchanging unit has a first heat exchanging port and a second heat exchanging port, said indoor heat distribution system further comprising a third indoor unidirectional valve and a fourth indoor unidirectional valve connected to a first heat exchanging port and a second heat exchanging port respectively, said third indoor unidirectional valve being configured to allow refrigerant to flow in a direction from said ventilating heat exchanging unit toward said second linkage port, said fourth indoor unidirectional valve being configured to allow refrigerant to flow in a direction from said ventilating heat exchanging unit toward said third linkage port.

15. The air conditioning and heat pump system, as recited in claim 14, wherein said indoor heat distribution system further comprises a second indoor flow regulator connected to said first heat exchanging port of said ventilating heat exchanging unit and in parallel with said third indoor unidirectional valve, and a second expansion valve connected to said second heat exchanging port of said ventilating heat exchanging unit and in parallel with said fourth indoor unidirectional valve.

16. The air conditioning and heat pump system, as recited in claim 15, wherein said energy efficient heat exchanger has a first refrigerant passing port and a second refrigerant passing port, said indoor heat distribution system further comprising a second indoor electrically-controlled two-way valve and a depressurizing valve connected to said second refrigerant passing port of said energy efficient heat exchanger and to said third linkage port, said first refrigerant passing port being connected to said third linkage port through said second indoor electrically-controlled two-way valve, said indoor heat distribution system further comprising a first indoor electrically-controlled two-way valve connected to said second refrigerant passing port and in parallel with said depressurizing valve, wherein said second refrigerant passing port is further connected to said second heat exchanging port through said first indoor electrically-controlled two-way valve.

17. The air conditioning and heat pump system, as recited in claim 16, wherein said indoor heat distribution system further comprises a third indoor electrically-controlled two-way valve and a fourth indoor electrically-controlled two-way valve, said third indoor electrically-controlled two-way valve being connected in parallel with said second indoor electrically-controlled two-way valve.

18. The air conditioning and heat pump system, as recited in claim 17, wherein when said air conditioning and heat pump system is in said air conditioning mode, said switching valve is switched to said air conditioning switching mode, said first electrically-controlled two-way valve is turned off while said second electrically-controlled two-way valve is turned on, said refrigerant being arranged to sequentially pass through said compressor, said first connecting port, said second connecting port, said first communicating port of said first outdoor heat exchanger, said second communicating port of said first outdoor heat exchanger, said first passage port of said second outdoor heat exchanger, said second passage port of said second outdoor heat exchanger, said unidirectional valve, said liquid inlet of said refrigerant storage tank, said liquid outlet of said refrigerant storage tank, said second electrically-controlled two-way valve, said third linkage port, said third indoor electrically-controlled two-way valve, said first indoor expansion valve, said second passing port of said indoor heat exchanger, said first passing port of said indoor heat exchanger, said first indoor unidirectional valve, said second linkage port, said fourth connecting port, said third connecting port, and back to said compressor.

19. The air conditioning and heat pump system, as recited in claim 17, wherein when said air conditioning and heat pump system is in said heat pump mode, said switching valve is switched to said heat pump switching mode, said first electrically-controlled two-way valve is turned, said second electrically-controlled two-way valve is turned off, said third indoor electrically-controlled two-way valve is turned off while said fourth indoor electrically-controlled two-way valve is turned on, said refrigerant being arranged to sequentially pass through said compressor, said first connecting port, said fourth connecting port, said second linkage port, said refrigerant passing through said second linkage port being arranged to pass through said first indoor flow regulator, said first passing port of said indoor heat exchanger, said second indoor flow regulator, and said first heat exchanging port of said ventilating heat exchanging unit, said refrigerant entering said indoor heat exchanger being arranged to pass through said second passing port, and said second indoor unidirectional valve, said refrigerant entering said ventilating heat exchanging unit being arranged to pass through said second heat exchanging port and said fourth indoor unidirectional valve, said refrigerant passing through said second indoor unidirectional valve and said fourth indoor unidirectional valve being arranged to merge and be guided to sequentially pass through said fourth indoor electrically-controlled two-way valve, said depressurizing valve, said second refrigerant passing port, said energy efficient heat exchanger, said first refrigerant passing port, said second indoor electrically-controlled two-way valve, said third linkage port, said third electrically-controlled two-way valve, said liquid inlet of said refrigerant storage tank, said liquid outlet of said refrigerant storage tank, said first electrically-controlled two-way valve, said expansion valve, said second communicating port of said first outdoor heat exchanger, said first communicating port of said first outdoor heat exchanger, said second connecting port, said third connecting port, and back to said compressor.

* * * * *